US007931128B2

(12) United States Patent
Sakai et al.

(10) Patent No.: US 7,931,128 B2
(45) Date of Patent: Apr. 26, 2011

(54) ELEVATOR DEVICE

(75) Inventors: Masaya Sakai, Tokyo (JP); Takaharu Ueda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 606 days.

(21) Appl. No.: 11/666,989

(22) PCT Filed: Jul. 25, 2006

(86) PCT No.: PCT/JP2006/314667
§ 371 (c)(1),
(2), (4) Date: May 3, 2007

(87) PCT Pub. No.: WO2007/013448
PCT Pub. Date: Feb. 1, 2007

(65) Prior Publication Data

US 2007/0284196 A1 Dec. 13, 2007

(30) Foreign Application Priority Data

Jul. 26, 2005 (JP) ..... PCT/JP2005/013640

(51) Int. Cl.
*B66B 1/28* (2006.01)

(52) U.S. Cl. ..... 187/293; 187/250; 187/276; 187/277; 187/289

(58) Field of Classification Search ..... 187/250, 187/276, 277, 289, 293
See application file for complete search history.

(56) References Cited

U.S. PATENT DOCUMENTS

| | | | | |
|---|---|---|---|---|
| 5,765,664 | A * | 6/1998 | Herkel et al. | 187/393 |
| 5,777,280 | A * | 7/1998 | Braasch et al. | 187/393 |
| 5,814,954 | A * | 9/1998 | Suzuki et al. | 318/376 |
| 6,264,005 | B1 * | 7/2001 | Kang et al. | 187/290 |
| 6,422,350 | B1 * | 7/2002 | Erker | 187/277 |
| 6,454,053 | B2 * | 9/2002 | Tominaga et al. | 187/290 |
| 2001/0017235 | A1 * | 8/2001 | Suga et al. | 187/290 |
| 2001/0017242 | A1 * | 8/2001 | Tajima et al. | 187/296 |
| 2003/0111302 | A1 * | 6/2003 | Utsunomiya et al. | 187/410 |
| 2004/0173413 | A1 * | 9/2004 | Angst et al. | 187/287 |

FOREIGN PATENT DOCUMENTS

| | | |
|---|---|---|
| CN | 1311150 | 9/2001 |
| CN | 1491179 | 4/2004 |
| JP | 40-2483 | 2/1940 |
| JP | 58-144076 | 2/1983 |
| JP | 58-42573 | 3/1983 |
| JP | 61-018512 | 5/1986 |

(Continued)

OTHER PUBLICATIONS

U.S. Appl. No. 11/666,989, filed May 3, 2007, Sakai et al.

(Continued)

*Primary Examiner* — Walter Benson
*Assistant Examiner* — Kawing Chan
(74) *Attorney, Agent, or Firm* — Oblon, Spivak, McClelland, Maier & Neustadt, L.L.P.

(57) ABSTRACT

In an elevator device, a drive unit has a drive sheave, a motor for rotating the drive sheave, and a motor driving portion for driving the motor. The motor driving portion is controlled by a control unit. When a car is running, the control unit monitors a load on at least one component within the drive unit, and generates a control command regarding a running speed of the car in accordance with a state of the load, and outputs the control command to the motor driving portion.

16 Claims, 18 Drawing Sheets

FOREIGN PATENT DOCUMENTS

| | | | |
|---|---|---|---|
| JP | 62-74890 | | 4/1987 |
| JP | 62-79182 | | 4/1987 |
| JP | 62-23708 | | 5/1987 |
| JP | 2-066084 | | 3/1990 |
| JP | 2-214486 | | 8/1990 |
| JP | 2-124981 | | 10/1990 |
| JP | 4-226283 | | 8/1992 |
| JP | 5 26968 | | 4/1993 |
| JP | 5-306074 | | 11/1993 |
| JP | 7 163191 | | 6/1995 |
| JP | 7 291542 | | 11/1995 |
| JP | 08-107669 | | 4/1996 |
| JP | 2567053 | | 10/1996 |
| JP | 9 2753 | | 1/1997 |
| JP | 9 233898 | | 9/1997 |
| JP | 10 164883 | | 6/1998 |
| JP | 2001 240319 | | 9/2001 |
| JP | 2002 3091 | | 1/2002 |
| JP | 2002-060147 | | 2/2002 |
| JP | 2003238037 | A * | 8/2003 |
| JP | 2005 57846 | | 3/2005 |
| JP | 2006-213447 | | 8/2006 |
| WO | 03 050028 | | 6/2003 |
| WO | 03 082721 | | 10/2003 |
| WO | 2005 030627 | | 4/2005 |
| WO | WO 2006046295 | A1 * | 5/2006 |

OTHER PUBLICATIONS

U.S. Appl. No. 12/064,394, filed Feb. 21, 2008, Ueda et al.
U.S. Appl. No. 11/666,989, filed May 3, 2007, Sakai et al.
U.S. Appl. No. 11/791,850, filed May 30, 2007, Ueda et al.
U.S. Appl. No. 11/666,989, filed May 3, 2007, Sakai et al.
U.S. Appl. No. 11/794,823, filed Jul. 6, 2007, Ueda et al.
U.S. Appl. No. 11/666,989, filed May 3, 2007, Sakai et al.
U.S. Appl. No. 12/532,414, Sep. 22, 2009, Ueda et al.
U.S. Appl. No. 12/812,609, filed Jul. 13, 2010, Ueda.

* cited by examiner

ELEVATOR DEVICE

TECHNICAL FIELD

The present invention relates to an elevator device having a car whose running speed is variable in accordance with a loading state of the car.

BACKGROUND ART

In a conventional elevator control device, the speed of a car during constant-speed running and the acceleration/deceleration of the car during accelerated/decelerated running are changed in accordance with a load on the car, within a drive range of a motor and an electric component for driving the motor. Thus, a margin of power of the motor is utilized, so the traveling efficiency of the car is improved (e.g., see Patent Document 1).

Patent Document 1: JP 2003-238037 A

DISCLOSURE OF THE INVENTION

Problems to be solved by the Invention

In the conventional elevator control device, however, a change in speed pattern is made based on a load on the car which has been detected by a weighing device. Therefore, the burdens on drive components such as the motor and an inverter may be increased when there is a great detection error in the weighing device or when there is a great running loss. When an attempt is made to calculate a speed pattern considering the error in the weighing device and the running loss in advance, the car is allowed to run more slowly than at an intrinsically attainable speed when the actual error or the actual loss is small. As a result, the capacities of the drive components cannot be brought out sufficiently.

The present invention has been made to solve the above-mentioned problems, and it is therefore an object of the present invention to obtain an elevator device allowing a car to be operated more efficiently while preventing a drive component from becoming overloaded.

Means for Solving the Problems

An elevator device according to the present invention includes: drive means having a drive sheave, a motor for rotating the drive sheave, and a motor driving portion for driving the motor; suspension means looped around the drive sheave; a car and a counterweight that are suspended by the suspension means to be raised/lowered by the drive means; and control means for controlling the motor driving portion, in which the control means monitors a load on at least one component within the drive means while the car is running, generates a control command regarding a running speed of the car in accordance with a state of the load, and outputs the control command to the motor driving portion.

BEST MODES FOR CARRYING OUT THE INVENTION

Preferred embodiments of the present invention will be described hereinafter with reference to the drawings.

Embodiment 1

Figure 1:
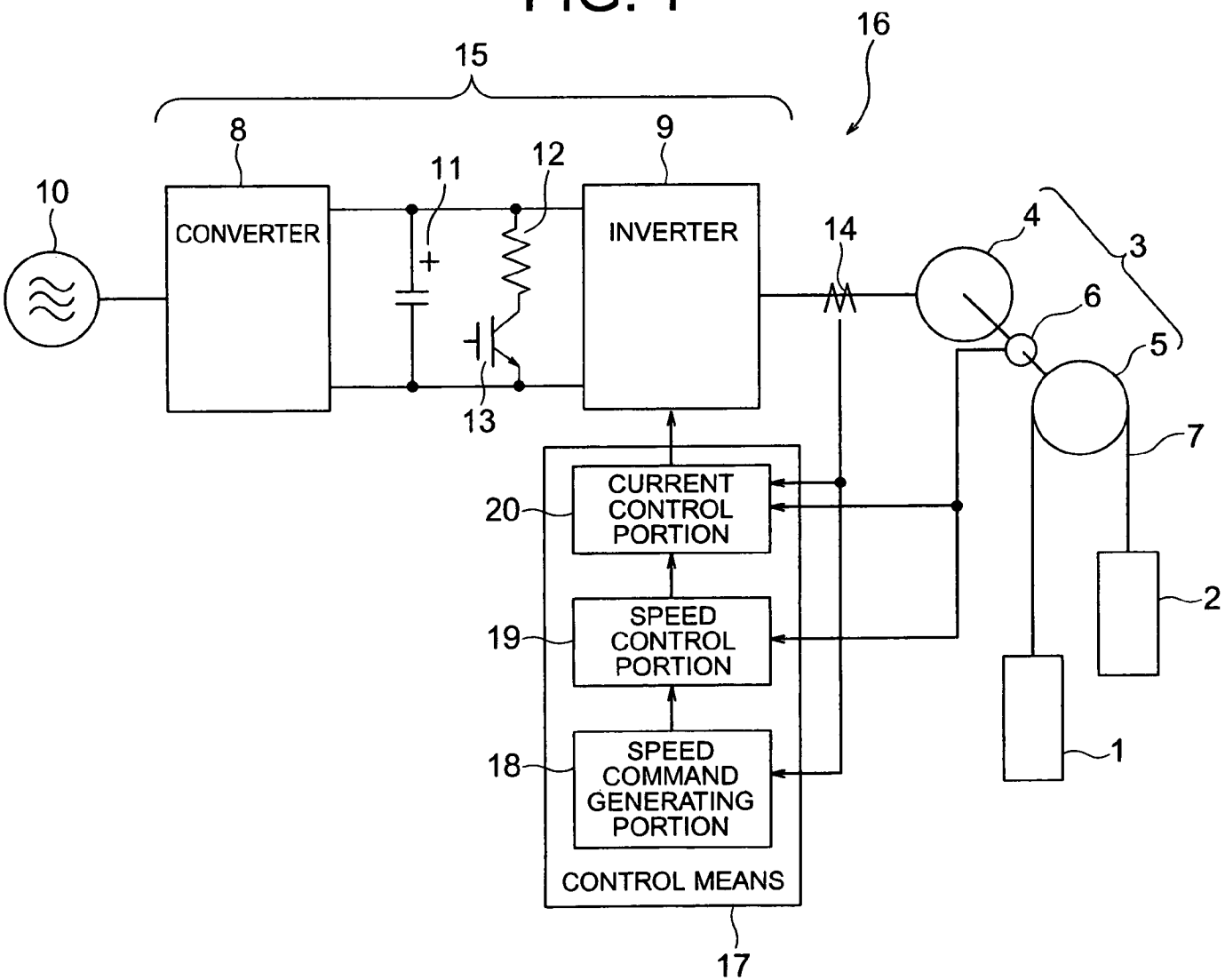
FIG. 1 is a schematic diagram showing an elevator device according to Embodiment 1 of the present invention.

FIG. 1 is a schematic diagram showing an elevator device according to Embodiment 1 of the present invention. A car 1 and a counterweight 2 are raised/lowered within a hoistway by a hoisting machine 3. The hoisting machine 3 has a motor 4, a drive sheave 5 that is rotated by the motor 4, a speed detector 6 for detecting a rotational speed of the motor 4 and positions of magnetic poles of the motor 4, and a brake (not shown) for braking rotation of the drive sheave 5. Employed as the speed detector 6 is, for example, an encoder or a resolver.

A plurality of main ropes 7 (only one of the main ropes 7 is shown in FIG. 1) as suspension means for suspending the car 1 and the counterweight 2 are looped around the drive sheave 5. Employable as the suspension means are, for example, normal ropes or belt-type ropes.

A power is supplied from a power supply 10 to the motor 4 via a converter 8 and an inverter 9. The converter 8 converts an AC voltage from the power supply 10 into a DC voltage. The inverter 9 creates an alternating current with an arbitrary voltage and an arbitrary frequency from the DC voltage generated by the converter 8. The inverter 9 performs the switching of the DC voltage to create the alternating current.

A smoothing capacitor 11 for smoothing a DC output from the converter 8 is connected between the converter 8 and the inverter 9. A regenerative resistor 12 and a regenerative switch 13 are connected in parallel to the smoothing capacitor 11. The value of a current supplied from the inverter 9 to the motor 4 is detected by a current detector 14.

The regenerative resistor 12 consumes a power regenerated during regenerative operation of the hoisting machine 3 as heat. Thus, when the voltage of the smoothing capacitor 11 exceeds a reference value, the regenerative switch 13 is turned ON to cause a current to flow through the regenerative resistor 12.

When the regenerative switch 13 is ON, the current flows through the regenerative resistor 12. Thus, the voltage of the smoothing capacitor 11 drops. Then, when the voltage of the smoothing capacitor 11 drops below a predetermined value, the regenerative switch 13 is turned OFF. Thus, the regenerative resistor 12 is stopped from being supplied with the current, so the voltage of the smoothing capacitor 11 is stopped from dropping.

As described above, the DC voltage input to the inverter 9 is controlled into a prescribed range by turning the regenerative switch 13 ON/OFF in accordance with the voltage of the smoothing capacitor 11. Employable as the regenerative switch 13 is, for example, a semiconductor switch.

A motor driving portion 15 for driving the motor 4 has the converter 8, the inverter 9, the smoothing capacitor 11, the regenerative resistor 12, the regenerative switch 13, and a breaker (not shown) for permitting/prohibiting the inputting of a current to the inverter 9. Drive means 16 for raising/lowering the car 1 and the counterweight 2 has the hoisting machine 3 and the motor driving portion 15.

The inverter 9 is controlled by control means 17. The control means 17 has a speed command generating portion 18, a speed control portion 19, and a current control portion 20. The speed command generating portion 18 generates a speed command for the car 1, namely, a speed command for the hoisting machine 3 in response to a registration of a call from a landing or a call from within the car 1.

The speed control portion 19 calculates a torque value based on the speed command generated by the speed command generating portion 18 and information from the speed detector 6, such that the rotational speed of the motor 4 coincides with the value of the speed command, and generates a torque command.

The current control portion 20 controls the inverter 9 based on a current detection signal from the current detector 14 and the torque command from the speed control portion 19. More specifically, the current control portion 20 converts the torque command from the speed control portion 19 into a current command value, and outputs a signal for driving the inverter 9 such that the current value detected by the current detector 14 coincides with the current command value.

Vector control is adopted in controlling the current of the inverter 9 through the current control portion 20. That is, the current control portion 20 calculates a voltage value to be output by the inverter 9 in accordance with the current command value obtained through conversion of the torque command, the current value of the motor 4 detected by the current detector 14, and positions of the magnetic poles (rotational positions) detected by the speed detector 6, and outputs an ON/OFF switching pattern to a built-in transistor in the inverter 9.

The control means 17 is constituted by a computer having a calculation processing portion (a CPU), a storage portion (a ROM, a RAM, a hard disk, and the like), and signal input/output portions. That is, the functions of the speed command generating portion 18, the speed control portion 19, and the current control portion 20 are realized by the computer.

The control means 17 generates a speed command such that the maximum speed of the car 1 and the acceleration of the car 1 are raised to the maximum within a permissible range of the drive means 16 to shorten the running time of the car 1. For this purpose, the control means 17 monitors the load on at least one of components within the drive means 16 while the car 1 is running, and generates a control command regarding the running speed of the car 1 without loss of time (on a real-time basis) based on the monitored load. When the car 1 starts running, the control means 17 raises the running speed of the car 1 until the monitored load reaches a preset threshold. The control command regarding the running speed means a command to change the speed of the car 1, for example, a speed command for the car 1 or a speed command for the hoisting machine 3.

The running speed of the car 1 is limited to an upper limit (Vmax) prescribed according to the performances of safety components such as a buffer (not shown), a brake (not shown), a safety gear (not shown), and a speed governor (not shown). Accordingly, the speed of the car 1 is held at Vmax to make a shift to constant-speed running unless the load monitored by the control means 17 reaches the threshold.

The speed command generating portion 18 in Embodiment 1 of the present invention monitors, for example, a current value of the motor 4, namely, a current value detected by the current detector 14 as a load on at least one of the drive components. Then, when the current value of the motor 4 reaches a preset threshold during accelerated running of the car 1, the speed command generating portion 18 generates a control command to cause the car 1 to run at a constant speed.

Figure 2:
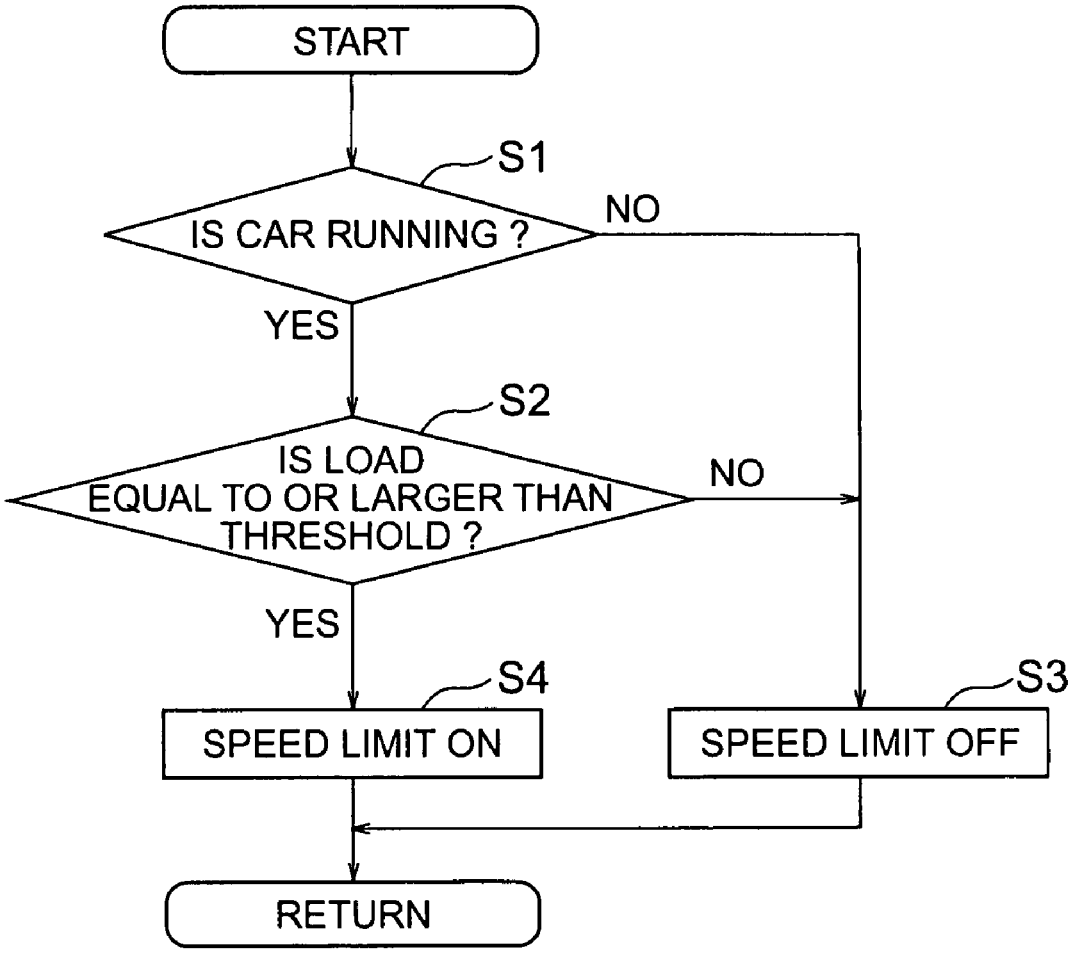
FIG. 2 is a flowchart showing a speed limit determining operation performed by a speed command generating portion of FIG. 1.

FIG. 2 is a flowchart showing a speed limit determining operation performed by the speed command generating portion 18 of FIG. 1. The speed command generating portion 18 determines whether or not the car 1 is running (Step S1). When the car 1 is running, the speed command generating portion 18 determines whether or not the load on the monitored component has reached a threshold (Step S2). When the car 1 is not running or when the load does not reach the threshold, the speed command generating portion 18 cancels a speed limit (Step S3). When the load reaches the threshold while the car 1 is running, the speed command generating portion 18 limits the running speed of the car 1 to a speed lower than Vmax. The speed command generating portion 18 repeatedly performs the speed limit determining operation as described above at intervals of a predetermined period.

Figure 3:
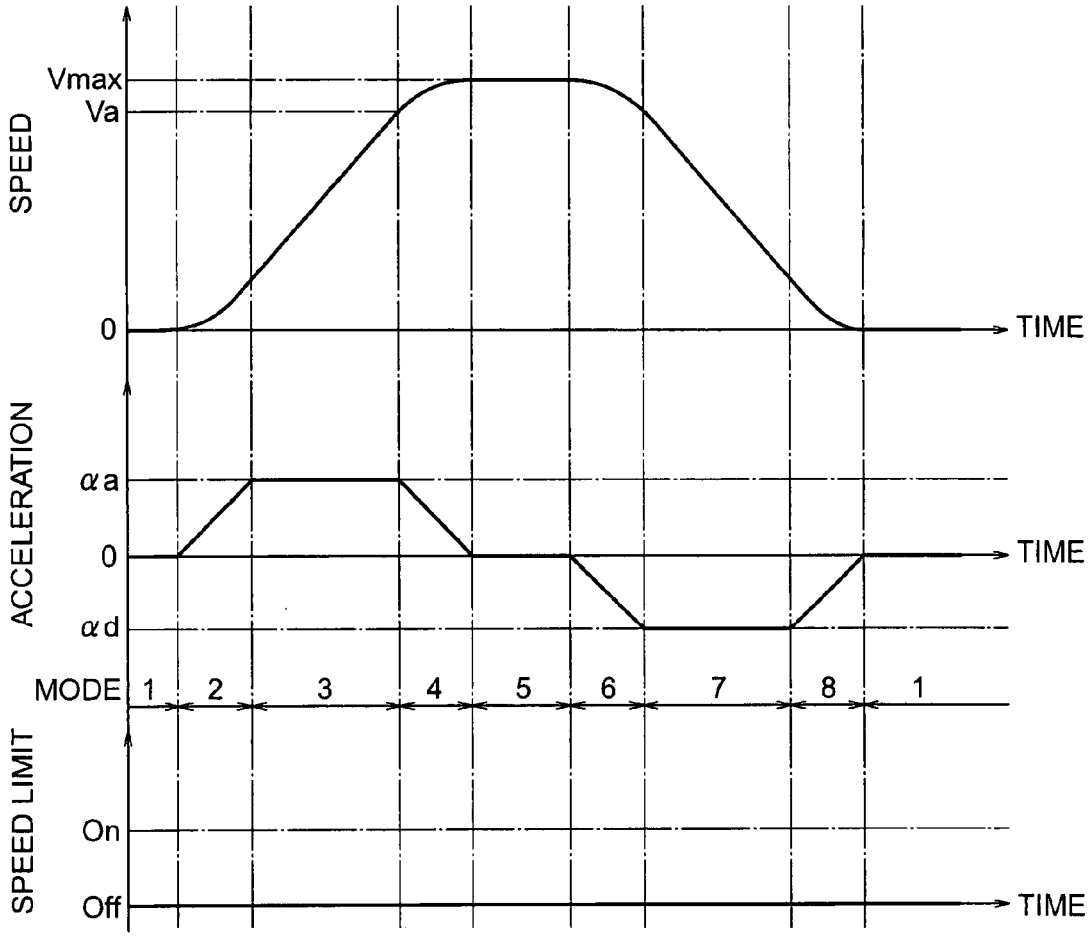
FIG. 3 is composed of graphs showing changes with time in the running speed of a car, the acceleration of the car, the running mode of the car, and the speed limit state of the car, respectively, when no speed limit is imposed on the car by the speed command generating portion of FIG. 1.
Figure 4:
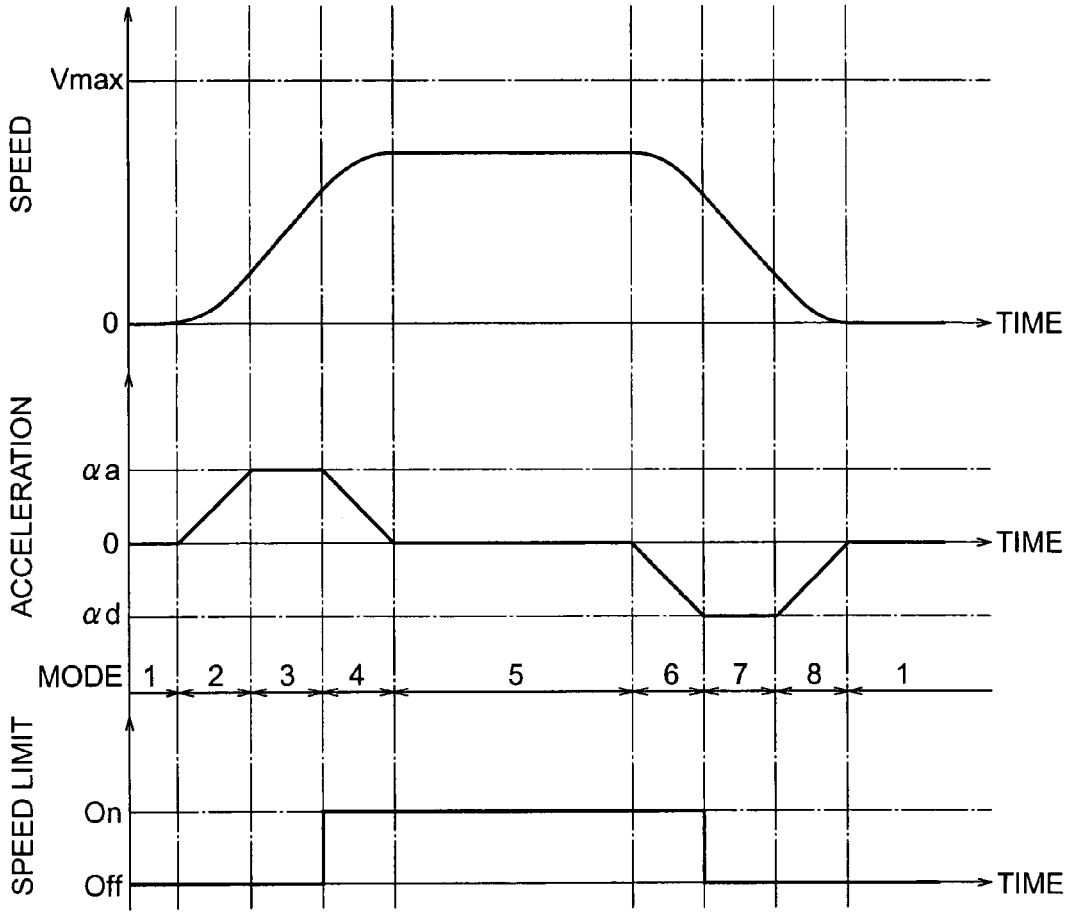
FIG. 4 is composed of graphs showing changes with time in the running speed of the car, the acceleration of the car, the running mode of the car, and the speed limit state of the car, respectively, when a speed limit is imposed on the car by the speed command generating portion of FIG. 1.

FIG. 3 is composed of graphs showing changes with time in the running speed of the car 1, the acceleration of the car 1, the running mode of the car 1, and the speed limit state of the car 1, respectively, when no speed limit is imposed on the car 1 by the speed command generating portion 18 of FIG. 1. FIG. 4 is composed of graphs showing changes with time in the running speed of the car 1, the acceleration of the car 1, the running mode of the car 1, and the speed limit state of the car 1, respectively, when a speed limit is imposed on the car 1 by the speed command generating portion 18 of FIG. 1.

Referring to FIGS. 3 and 4, MODE 1 is a state (stop state) of no input of an activation command and speed command=0. MODE 2 is a state of acceleration>0 and jerk>0. MODE 3 is a state of acceleration>0 and jerk=0. MODE 4 is a state of acceleration>0 and jerk<0. MODE 5 is a state of constant speed. MODE 6 is a state of acceleration<0 and jerk<0. MODE 7 is a state of acceleration<0 and jerk=0. MODE 8 is a state of acceleration<0 and jerk>0. The acceleration in MODE 7 is a preset maximum deceleration αd.

When the load on the component does not reach the threshold during acceleration in MODE 3, a shift to MODE 4 (acceleration transition) is made at a preset speed Va, and a shift to constant-speed running (MODE 5) is then made at the speed Vmax, as shown in FIG. 3.

On the other hand, when the load on the component reaches the threshold during acceleration in MODE 3, a shift to MODE 4 (acceleration transition) is made immediately, and a shift to constant-speed running (MODE 5) is then made at a speed lower than the speed Vmax, as shown in FIG. 4.

Figure 5:
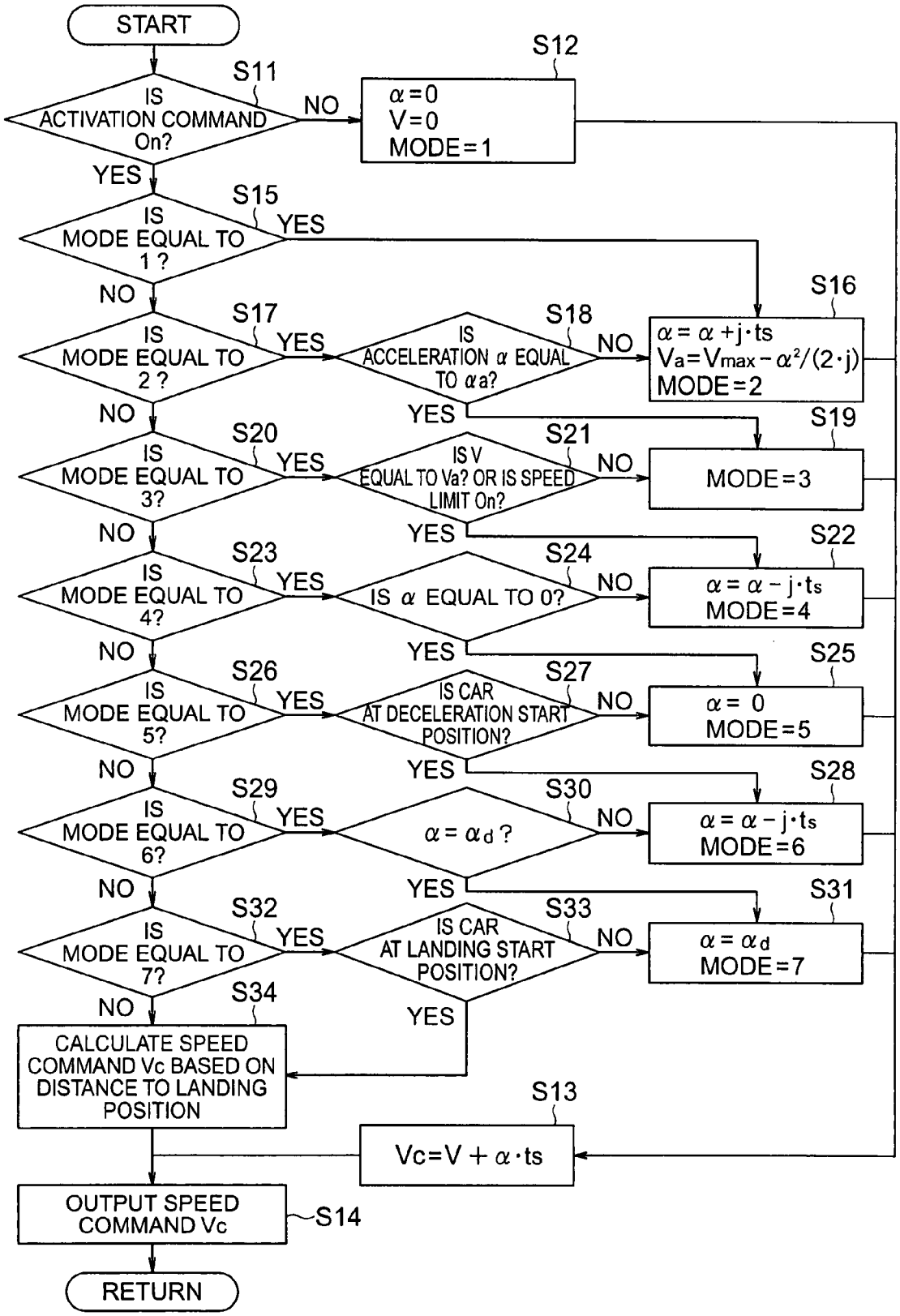
FIG. 5 is a flowchart showing a mode switchover operation performed by the speed command generating portion of FIG. 1.

Reference will be made next to FIG. 5. FIG. 5 is a flowchart showing a mode switchover operation performed by the speed command generating portion 18 of FIG. 1. The speed command generating portion 18 repeatedly performs the mode switchover operation as shown in FIG. 5 at intervals of a predetermined period (a time sufficiently shorter than the running time of the car 1: e.g., 50 milliseconds). In the mode switchover operation, the speed command generating portion 18 first determines whether or not an activation command has been input to the control means 17 (Step S11). When no activation command is input thereto, the speed command generating portion 18 makes settings of acceleration α=0, speed V=0, and MODE=1 (Step S12). After that, the speed command generating portion 18 assigns acceleration α=0 and speed V=0 to an expression (1) to calculate a speed command Vc (Step S13).

$$Vc=V+\alpha\cdot ts \tag{1}$$

After that, the speed command generating portion 18 outputs the calculated speed command Vc to the speed control portion 19 (Step S14), thereby terminating a calculation on a current cycle.

When the activation command is input to the control means 17, the speed command generating portion 18 determines whether or not MODE=1 (Step S15). When MODE=1, the first calculation is to be performed after the activation command has been input, so the speed command generating portion 18 makes a setting of MODE=2. In this case, the speed command generating portion 18 sets the acceleration α according to an expression (2), and sets the transition speed Va for shifting from MODE=3 to MODE=4 according to an expression (3) (Step S16).

$$\alpha=\alpha+j\cdot ts \tag{2}$$

$$Va=V\max-\alpha^2/(2\cdot j) \tag{3}$$

It should be noted herein that j denotes a jerk, that Vmax denotes a maximum speed in a speed command, and that ts denotes a calculation period. The acceleration α obtained through the last calculation is assigned to a on the right-hand side of the expression (2).

After that, the speed command generating portion 18 performs the calculation of the expression (1) (Step S13). In this case, the speed command generating portion 18 assigns the speed command Vc obtained through the last calculation to the speed V on the right-hand side of the expression (1), and assigns the acceleration α calculated according to the expression (2) to the acceleration α on the right-hand side of the expression (1). Thus, a new speed command Vc is calculated. After that, the speed command generating portion 18 outputs the calculated speed command Vc to the speed control portion 19 (Step S14), thereby terminating the calculation on the current cycle.

Then, when MODE≠1, the speed command generating portion 18 determines whether or not MODE=2 (Step S17). When MODE=2, the speed command generating portion 18 determines whether or not the acceleration α reaches a maximum acceleration αa (Step S18). When the acceleration α does not reach the maximum acceleration αa, the speed command generating portion 18 sets the acceleration α according to the expression (2), and sets the transition speed Va according to the expression (3). Then, the speed command generating portion 18 maintains a state of MODE=2 (Step S16).

On the other hand, when the acceleration α reaches the maximum acceleration αa, the speed command generating portion 18 makes a shift to a state of MODE=3 while maintaining the acceleration α and the transition speed Va (Step S19).

After that, the speed command generating portion 18 calculates the speed command Vc on the current calculation cycle (Step S13), and outputs the speed command Vc to the speed control portion 19 (Step S14), thereby terminating the calculation on the current cycle.

Then, when MODE≠2, the speed command generating portion 18 determines whether or not MODE=3 (Step S20). When MODE=3, the speed command generating portion 18 determines whether or not the speed command Vc is equal to the transition speed Va, and whether or not there is a need to impose a speed limit for the reason that the load on at least one of the components within the drive means 16 has reached the threshold (Step S21). When the speed command Vc does not reach the transition speed Va and there is no need to impose the speed limit, the speed command generating portion 18 maintains the acceleration α and the transition speed Va to maintain the state of MODE=3 (Step S19). When the speed command Vc reaches the transition speed Va and there is a need to impose the speed limit, the speed command generating portion 18 sets the acceleration a according to an expression (4) to make a shift to a state of MODE=4 (Step S22). The speed command generating portion 18 assigns the acceleration α obtained through the last calculation to the acceleration α on the right-hand side of the expression (4).

$$\alpha=\alpha-j\cdot ts \tag{4}$$

After that, the speed command generating portion 18 calculates the speed command Vc on the current calculation cycle (Step S13), and outputs the speed command Vc to the speed control portion 19 (Step S14), thereby terminating the calculation on the current cycle.

Then, when MODE≠3, the speed command generating portion 18 determines whether or not MODE=4 (Step S23). When MODE=4, the speed command generating portion 18 determines whether or not the acceleration α has reached 0 (Step S24). When the acceleration α does not reach 0, the speed command generating portion 18 sets the acceleration α according to the expression (4) to maintain the state of MODE=4 (Step S22). When the acceleration α reaches 0, the speed command generating portion 18 sets the acceleration α to 0 to make a shift to a state of MODE=5 (Step S25).

After that, the speed command generating portion 18 calculates the speed command Vc on the current calculation cycle (Step S13), and outputs the speed command Vc to the speed control portion 19 (Step S14), thereby terminating the calculation on the current cycle.

Then, when MODE≠4, the speed command generating portion 18 determines whether or not MODE=5 (Step S26). When MODE=5, the speed command generating portion 18 determines whether or not the car 1 reaches a deceleration start position (Step S27). When the car 1 does not reach the deceleration start position, the speed command generating portion 18 holds the acceleration α at 0 to maintain the state of MODE=5 (Step S25). When the car 1 reaches the deceleration start position, the speed command generating portion 18 sets the acceleration α according to the expression (4) to make a shift to a state of MODE=6 (Step S28).

After that, the speed command generating portion 18 calculates the speed command Vc on the current calculation cycle (Step S13), and outputs the speed command Vc to the speed control portion 19 (Step S14), thereby terminating the calculation on the current cycle.

Then, when MODE≠5, the speed command generating portion 18 determines whether or not MODE=6 (Step S29). When MODE=6, the speed command generating portion 18 determines whether or not the acceleration α has reached the preset maximum deceleration αd (Step S30). When the acceleration α does not reach the maximum deceleration αd, the speed command generating portion 18 sets the acceleration α according to the expression (4) to maintain the state of MODE=6 (Step S28). When the acceleration α reaches the maximum deceleration αd, the speed command generating portion 18 sets the acceleration α to the maximum deceleration αd to make the setting of MODE=7 (Step S31).

After that, the speed command generating portion 18 calculates the speed command Vc on the current calculation cycle (Step S13), and outputs the speed command Vc to the speed control portion 19 (Step S14), thereby terminating the calculation on the current cycle.

Then, when MODE≠6, the speed command generating portion 18 determines whether or not MODE=7 (Step S32). When MODE=7, the speed command generating portion 18 determines whether or not the car 1 has reached a landing start position (Step S33). When the car 1 does not reach the landing start position, the speed command generating portion 18 holds the acceleration α at the maximum deceleration αd to maintain a state of MODE=7 (Step S31).

After that, the speed command generating portion 18 calculates the speed command Vc on the current calculation cycle (Step S13), and outputs the speed command Vc to the speed control portion 19 (Step S14), thereby terminating the calculation on the current cycle.

When the car 1 reaches the landing start position, the speed command generating portion 18 calculates the speed command Vc based on a distance to a landing position of the car 1, and makes a shift to a state of MODE=8 (Step S34). After that, the speed command generating portion 18 outputs the calculated speed command Vc to the speed control portion 19 (Step S14), thereby terminating the calculation on the current cycle.

Figure 6:
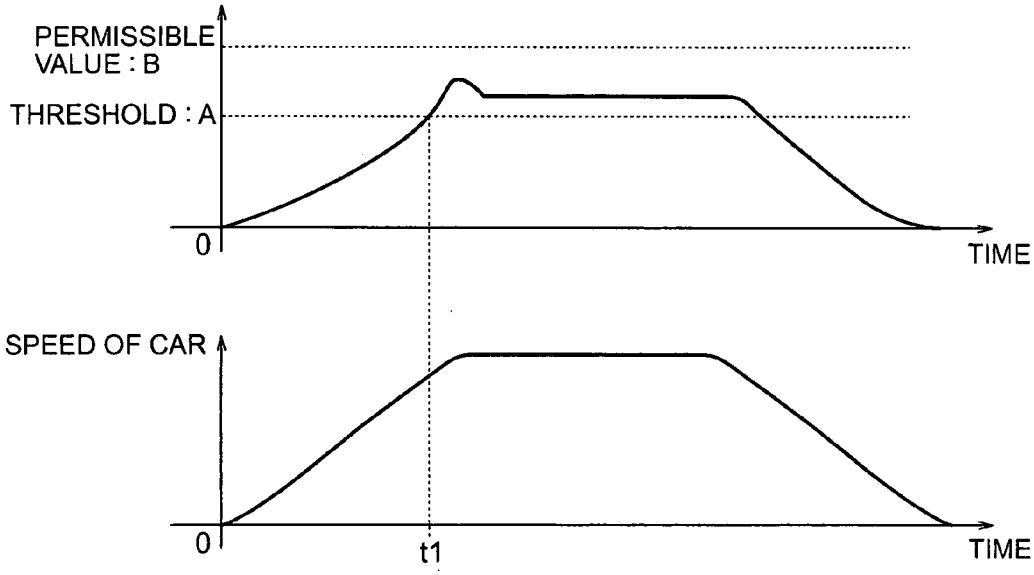
FIG. 6 is composed of graphs showing changes with time in the load state of a component of drive means and the speed of the car, respectively, when the car is caused to run through the mode switchover operation of FIG. 5.

FIG. 6 is composed of graphs showing changes with time in the load state of at least one of the components of the drive means 16 and the speed of the car 1, respectively, when the car 1 is caused to run through the mode switchover operation of FIG. 5. A threshold A is set lower than a permissible value B of the load on the component. In other words, a predetermined margin is provided between the threshold A and the permissible value B.

As shown in FIG. 6, when the load on the component reaches the threshold A at a time point t1, the acceleration of the car 1 is reduced and then a shift to constant-speed running is made. The load on the component rises after the time point t1 as well, but decreases before reaching the permissible value B and stabilizes at a value lower than the permissible value B.

In the elevator device structured as described above, the load on at least one of the components within the drive means 16 is monitored while the car 1 is running, and the control command regarding the running speed of the car 1 is generated in accordance with the state of the load and then output to the motor driving portion 15, instead of generating a speed pattern in accordance with a load within the car 1 when the car 1 starts running. It is therefore possible to operate the car 1 more efficiently while preventing at least one of the drive components from becoming overloaded.

The control means 17 continuously raises the running speed of the car 1 after the car 1 has started running, and reduces the acceleration of the car 1 when the monitored load reaches the threshold It is therefore possible to further improve the operating efficiency of the car 1.

Further, after the car 1 has started running, the control means 17 raises the acceleration of the car 1 at the predetermined jerk until the acceleration of the car 1 reaches the predetermined acceleration. It is therefore possible to further improve the operating efficiency of the car 1.

Still further, when the load on the component reaches the threshold during accelerated running of the car 1, the control means 17 generates the control command to cause the car 1 to run at the constant speed. It is therefore possible to more reliably prevent at least one of the drive components from becoming overloaded.

Embodiment 2

Figure 7:
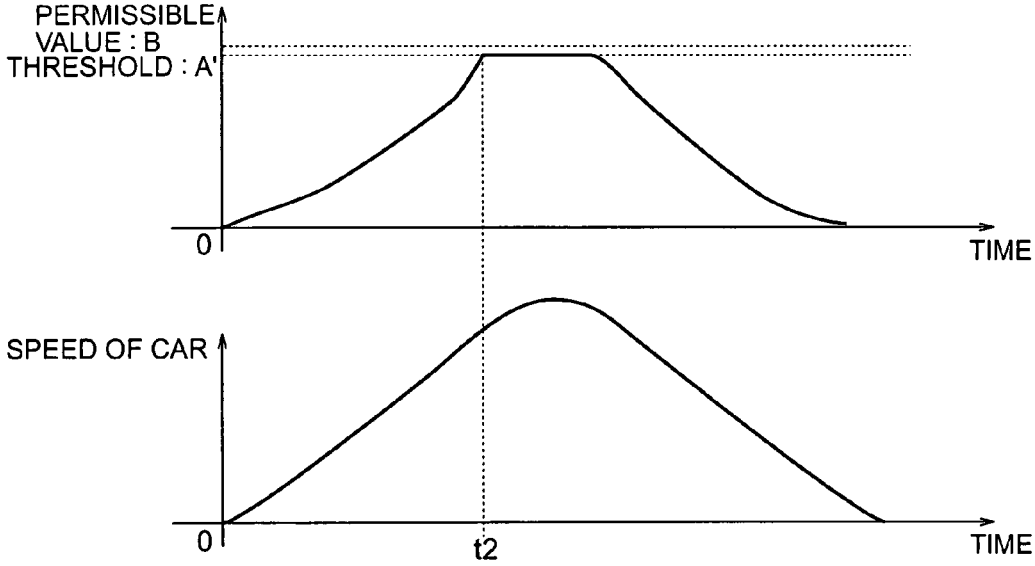
FIG. 7 is composed of graphs showing changes with time in the load state of a component of drive means and the speed of a car, respectively, in an elevator device according to Embodiment 2 of the present invention.

Reference will be made next to FIG. 7. FIG. 7 is composed of graphs showing changes with time in the load state of at least one of components of drive means and the speed of a car, respectively, in an elevator device according to Embodiment 2 of the present invention. The overall construction of the device is the same as that of Embodiment 1 of the present invention (FIG. 1). A threshold A' is set lower than the permissible value B of the load on the component. In other words, a predetermined margin is provided between the threshold A' and the permissible value B.

In Embodiment 2 of the present invention, when the load on the component reaches the threshold A' during accelerated running of the car 1, the control means 17 generates a control command, namely, a speed command such that the load is held at the threshold A'. Referring to FIG. 7, the load on the component reaches the threshold A' at a time point t2, but the speed of the car 1 rises gently after that as well. Embodiment 2 of the present invention is identical to Embodiment 1 of the present invention in other constructional details and other details about the method of control.

In the elevator device structured as described above, when the load on at least one of the components of the drive means 16 reaches the threshold A', the speed command is generated such that the load follows the threshold A'. Thus, the threshold A' can be set close to the permissible value B. Accordingly, it is possible to achieve a further improvement in operating efficiency.

In the foregoing example, the motor current is mentioned as the load on at least one of the components monitored by the control means 17. As a matter of course, however, the load on the component is not limited thereto.

For instance, the load monitored by the control means 17 may be a voltage of the motor 4 or a temperature of the motor 4. The voltage of the motor 4 can be detected by a voltage detector provided on the motor 4. A voltage command value for the inverter 9, which is generated within the control means 17, may be used instead of a detected value of the voltage of the motor 4. In addition, the temperature of the motor 4 can be detected by a temperature detector provided on the motor 4. The temperature of the motor 4 can also be estimated from an integrated value of the current of the motor 4.

The load monitored by the control means 17 may also be a current of the inverter 9, a temperature of the inverter 9, a switching duty of the inverter 9, or an output voltage of the inverter 9. The current of the inverter 9 can be detected by a current detector provided on the inverter 9. The temperature of the inverter 9 can be detected by a temperature detector provided on the inverter 9. Further, the temperature of the inverter 9 can also be estimated from an integrated value of the current of the inverter 9. Still further, the switching duty of the inverter 9 can be calculated from a voltage command value for the inverter 9 which is generated within the control means 17. The output voltage of the inverter 9 can be detected by a voltage detector provided on the inverter 9. In addition, a voltage command value for the inverter 9, which is generated within the control means 17, may be used instead of a detected value of the output voltage of the inverter 9.

Further, the load monitored by the control means 17 may be at least one of a d-axis current and a q-axis current, which have been obtained by converting a current supplied to the motor 4 into values in the Cartesian coordinate system.

Still further, the load monitored by the control means 17 may be at least one of a d-axis current command and a q-axis current command in the Cartesian coordinate system, which have been generated to control the inverter 9.

The load monitored by the control means 17 may be a power supplied from the inverter 9 to the motor 4. This power can be calculated as q-axis current (or q-axis current command)×car speed (or speed command value). The power can also be calculated as current measurement value (or current command value)×speed measurement value (or speed command value). The power can also be calculated as current measurement value (or current command value)×voltage measurement value (or voltage command value).

Further, the load monitored by the control means 17 may be a temperature of the regenerative resistor 12. The temperature of the regenerative resistor 12 can be detected by a temperature detector provided on the regenerative resistor 12. The temperature of the regenerative resistor 12 can also be estimated from a state (switching duty) of the regenerative switch 13.

Still further, the load monitored by the control means 17 may be a regenerative power obtained through the regenerative resistor 12. The regenerative power can be estimated from a state (switching duty) of the regenerative switch 13.

The load monitored by the control means 17 may be a current flowing through the breaker connected between the inverter 9 and the power supply 10. The current of the breaker can be detected by a current detector provided on the breaker.

Further, the load monitored by the control means 17 may be a DC voltage (DC bus voltage) input from the converter 8 to the inverter 9. The voltage input to the inverter 9 can be detected by a voltage detector.

Still further, although the loads on the components are individually monitored in the foregoing example, it is also appropriate to monitor a plurality of kinds of loads in combination and reduce the acceleration of the car 1 when one of the loads reaches a threshold. It is also appropriate to monitor a plurality of kinds of loads in combination and reduce the acceleration of the car 1 when some of the loads reach respective thresholds.

Although the load on at least one of the components is directly monitored in the foregoing example, it is also possible to compare a command value generated within the control means 17 with an actual drive state of the component to estimate and monitor the load on the component indirectly.

For example, it is possible to compare a current command value generated in the current control portion 20 of FIG. 1 with a current measurement value measured based on a signal from the current detector 14 to estimate the load on the component. In this case, it is appropriate to monitor at least one of a difference between the current command value and the current measurement value and a derivative value of the difference between the current command value and the current measurement value, and reduce the acceleration of the car 1 when the monitored value reaches a threshold.

By the same token, it is possible to compare a speed command value generated in the speed command generating portion 18 of FIG. 1 with a speed measurement value measured based on a signal from the speed detector 6 to estimate the load on the component. In this case, it is appropriate to monitor at least one of a difference between the speed command value and the speed measurement value and a derivative value of the difference between the speed command value and the speed measurement value, and reduce the acceleration of the car 1 when the monitored value reaches a threshold.

It is also possible to indirectly estimate and monitor the load on the component based on a value of a weighing device for the car 1. Although there is an error in the weighing device in this case as well, there is no increase in the burden on the drive components resulting from a running loss. In comparison with a case where the running loss is expected, there is also an advantage in that the performances of the drive components can be brought out sufficiently.

Embodiment 3

Next, Embodiment 3 of the present invention will be described. In Embodiment 3 of the present invention, the switching duty of the inverter 9 is monitored as a load on at least one of the components of the drive means 16.

Figure 8:
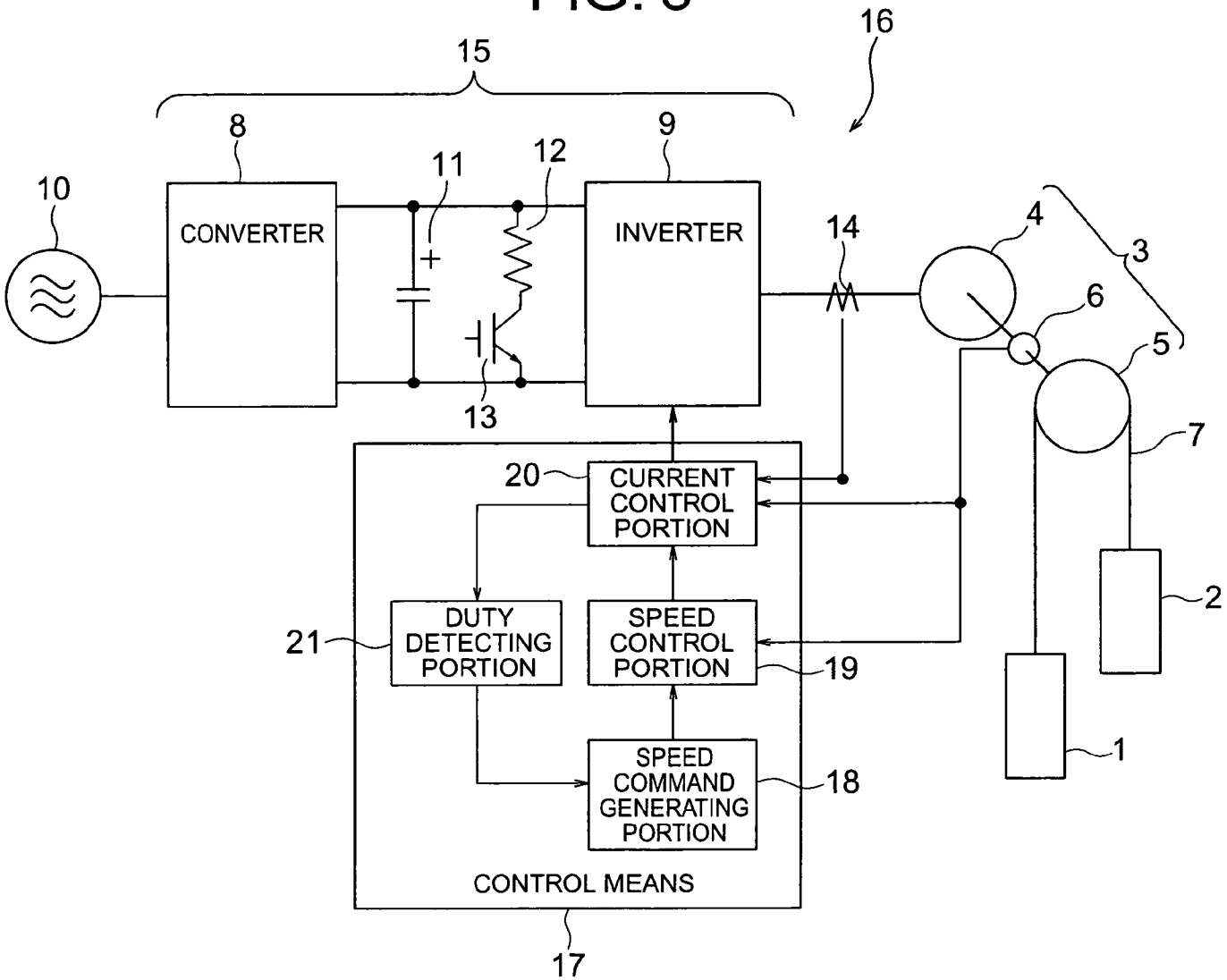
FIG. 8 is a schematic diagram showing an elevator device according to Embodiment 3 of the present invention.

FIG. 8 is a schematic diagram showing an elevator device according to Embodiment 3 of the present invention. Referring to FIG. 8, the control means 17 has a duty detecting portion 21 in addition to the speed command generating portion 18, the speed control portion 19, and the current control portion 20. Based on a voltage command value for the inverter 9, which is generated in the current control portion 20, the duty detecting portion 21 detects a switching duty as a load on the inverter 9. The switching duty is a ratio of a time period in which the inverter 9 is ON within a predetermined sampling period.

The speed command generating portion 18 monitors whether or not the switching duty of the inverter 9, which has been detected by the duty detecting portion 21, reaches a preset threshold while the car 1 is running. Then, when the switching duty reaches the threshold, the speed command generating portion 18 imposes a speed limit. Embodiment 3 of the present invention is identical to Embodiment 1 or 2 of the present invention in other constructional details and other details about the method of control.

Figure 9:
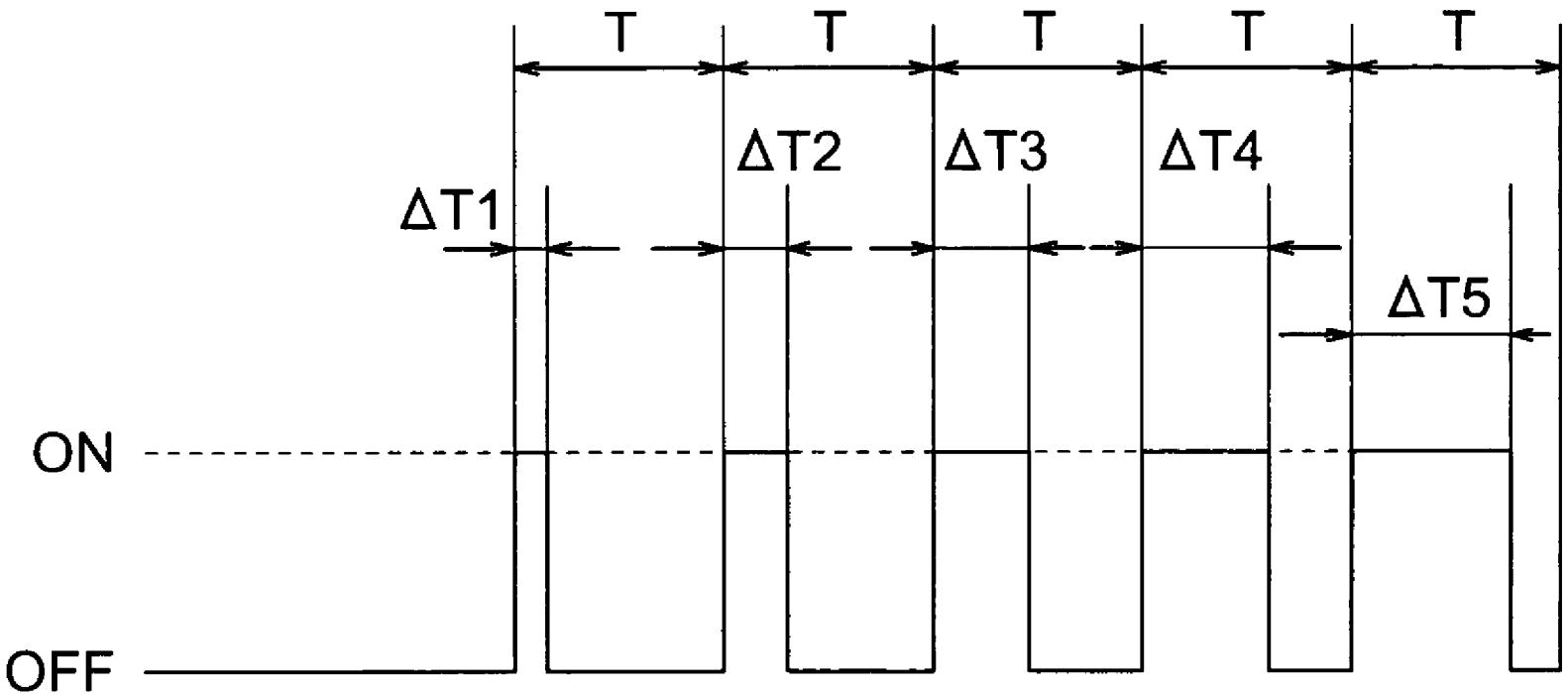
FIG. 9 is an explanatory diagram showing an example of changes in a switching duty detected by a duty detecting portion of FIG. 8.

FIG. 9 is an explanatory diagram showing an example of changes in the switching duty detected by the duty detecting portion 21 of FIG. 8. Referring to FIG. 9, a duty value Ti in a sampling period T is calculated as ΔTi/T.

In a case where the car 1 is in power running operation, for example, when the car 1 is raised with a rated number of passengers on board, the value of the switching duty gradually increases as the car 1 increases in speed after having started running (ΔT1/T<ΔT2/T<ΔT3/T<ΔT4/T<ΔT5/T).

In the elevator device structured as described above, the switching duty of the inverter 9 is monitored while the car 1 is running, and the speed command is generated without loss of time in accordance with the state of the switching duty and then output to the motor driving portion 15. It is therefore possible to operate the car 1 more efficiently while preventing at least one of the drive components from becoming overloaded.

The product of the switching duty and the bus voltage (voltage input to inverter 9) is equal to the voltage of the motor 4. Accordingly, when the amplitude of fluctuations in bus voltage is low, voltage saturation of the motor 4 can be avoided beforehand by monitoring the switching duty.

It is appropriate to set the threshold in accordance with the acceleration of the car 1 or the acceleration transition pattern of the car 1 such that the switching duty does not exceed the permissible value. Alternatively, it is also appropriate to set the acceleration of the car 1 or the acceleration transition pattern of the car 1 in accordance with the threshold such that the switching duty does not exceed the permissible value.

It is appropriate to set a deceleration of the car 1 and a deceleration transition pattern of the car 1 and then set the threshold such that the switching duty does not exceed the permissible value. Alternatively, it is also appropriate to set the threshold and then set the deceleration of the car 1 and the deceleration transition pattern of the car 1 such that the switching duty does not exceed the permissible value.

Further, it is also appropriate to reset the threshold every time the car 1 runs.

Still further, it is also appropriate to switch over the threshold depending on whether or not the motor 4 is in power running operation or regenerative operation. For example, when there is a thermal surplus in the regenerative resistor 12, the values of maximum speed and drive torque can be made higher during regenerative operation than during power running operation. As a result, it is possible to perform the operation of the car 1 more efficiently.

There is a relationship of trade-off between the threshold and the deceleration of the car 1 or between the threshold and the deceleration transition pattern of the car 1. It is therefore preferable to set the threshold, the deceleration of the car 1, and the deceleration transition pattern of the car 1 such that the running time of the car 1 is shortened.

Embodiment 4

Next, Embodiment 4 of the present invention will be described. In Embodiment 4 of the present invention, a motor voltage is monitored as a load on at least one of the components of the drive means 16.

Figure 10:
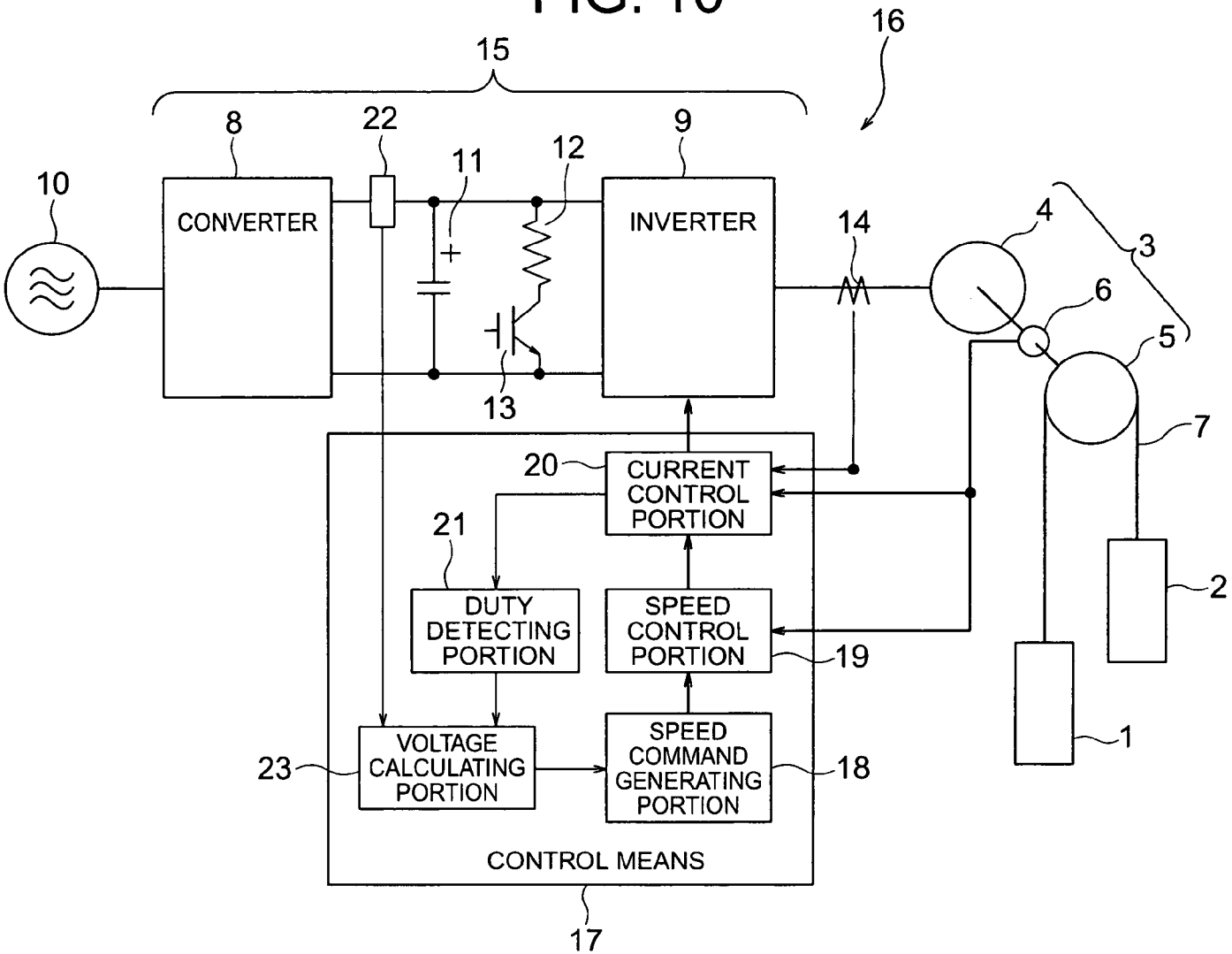
FIG. 10 is a schematic diagram showing an elevator device according to Embodiment 4 of the present invention.

FIG. 10 is a schematic diagram showing an elevator device according to Embodiment 4 of the present invention. Referring to FIG. 10, a bus voltage detector 22 for detecting a bus voltage (DC voltage) smoothed by the smoothing capacitor 11 is provided between the converter 8 and the inverter 9.

The control means 17 has a voltage calculating portion 23 in addition to the speed command generating portion 18, the speed control portion 19, the current control portion 20, and the duty detecting portion 21. The voltage calculating portion 23 calculates a voltage applied to the motor 4 from a bus voltage detected based on a signal from the bus voltage detector 22 and a switching duty detected by the duty detecting portion 21.

The speed command generating portion 18 determines whether or not a motor voltage calculated by the voltage calculating portion 23 reaches a preset threshold while the car 1 is running. Then, when the motor voltage reaches the threshold, the speed command generating portion 18 imposes a speed limit. Embodiment 4 of the present invention is identical to Embodiment 3 of the present invention in other constructional details and other details about the method of control.

In the elevator device structured as described above, the voltage applied to the motor 4 can be calculated accurately even when the bus voltage fluctuates due to fluctuations in the voltage of the power supply 10. It is therefore possible to more reliably prevent the motor 4 from becoming overloaded.

Embodiment 5

Next, Embodiment 5 of the present invention will be described. In Embodiment 5 of the present invention, a motor voltage is monitored as a load on at least one of the components of the drive means 16.

Figure 11:
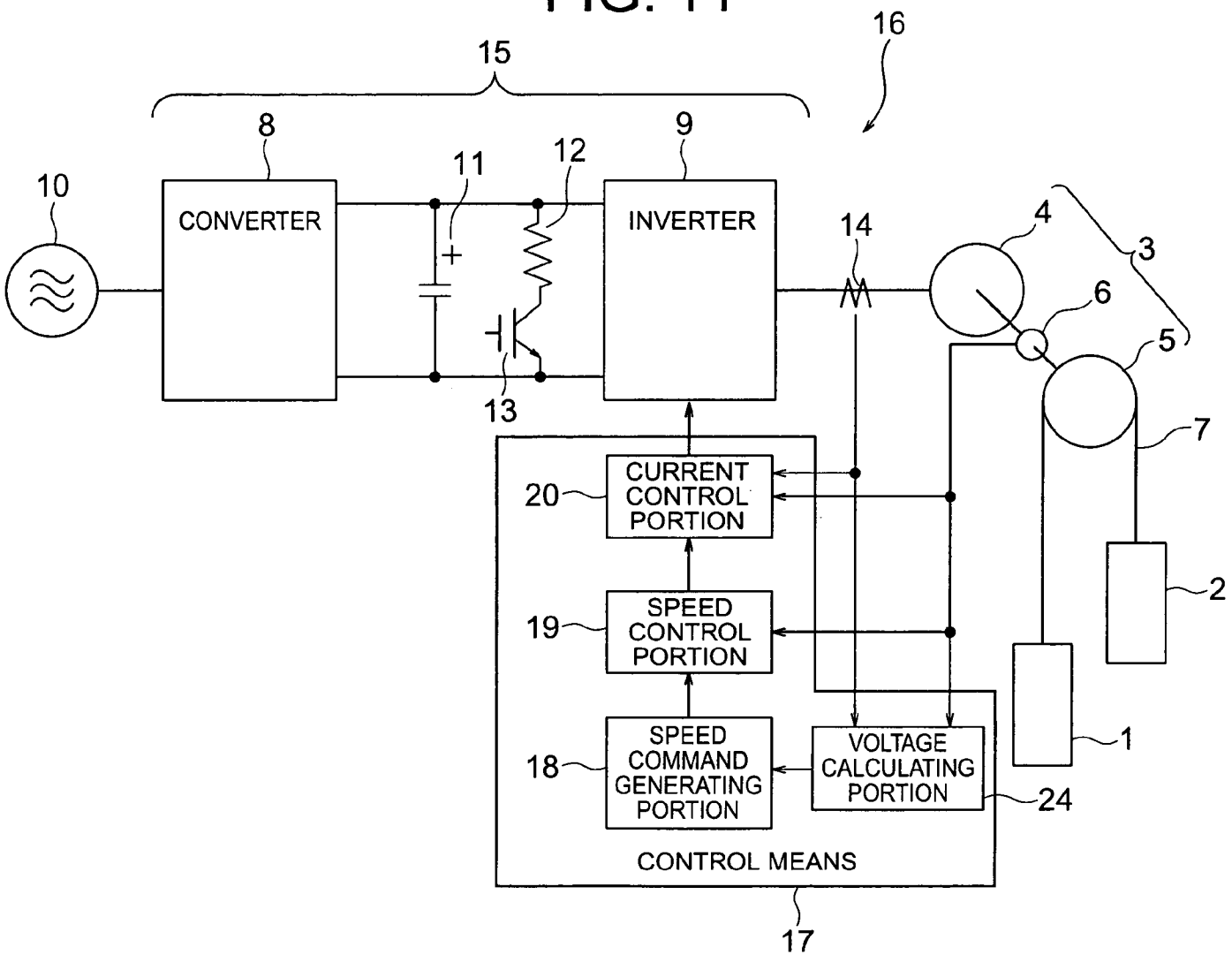
FIG. 11 is a schematic diagram showing an elevator device according to Embodiment 5 of the present invention.

FIG. 11 is a schematic diagram showing an elevator device according to Embodiment 5 of the present invention. Referring to FIG. 11, the control means 17 has a voltage calculating portion 24 in addition to the speed command generating portion 18, the speed control portion 19, and the current control portion 20. The voltage calculating portion 24 calculates a voltage applied to the motor 4 based on a signal from the speed detector 6 and a signal from the current detector 14. In general, a motor voltage can be obtained through calculation from a current value, a rotational speed, and positions of magnetic poles.

The speed command generating portion 18 determines whether or not the motor voltage calculated by the voltage calculating portion 24 reaches a preset threshold while the car 1 is running. When the motor voltage reaches the threshold, the speed command generating portion 18 imposes a speed limit. Embodiment 5 of the present invention is identical to Embodiment 1 or 2 of the present invention in other constructional details and other details about the method of control.

In the elevator device structured as described above, the motor voltage is monitored while the car 1 is running, and a speed command is generated without loss of time in accordance with a state of the motor voltage and then output to the motor driving portion 15. It is therefore possible to operate the car 1 more efficiently while preventing at least one of the drive components from becoming overloaded.

In a case where a permanent-magnet synchronous motor is employed as the motor 4, the motor voltage increases depending mainly on the rotational speed of the motor 4. The motor 4 cannot be operated at such a speed that the motor voltage exceeds a voltage value allowed to be output from the inverter 9. Therefore, a deterioration in speed control or electromagnetic noise resulting from current distortion is caused when the motor voltage reaches an upper limit of the voltage allowed to be output from the inverter 9.

In Embodiment 5 of the present invention, a threshold of the motor voltage is set based on a maximum value of the voltage allowed to be output from the inverter 9. When the motor voltage exceeds the threshold, the speed command generating portion 18 outputs an acceleration transition command value to make a shift to constant-speed running. Then, the speed command generating portion 18 calculates a deceleration command value at a deceleration start position to stop the car 1. The motor voltage increases temporarily between a time point corresponding to the start of acceleration transition and a time point corresponding to the start of constant-speed running. In this case as well, the threshold is set such that the motor voltage does not exceed a permissible value. Owing to the foregoing measure, it is possible to achieve an increase in operational speed while preventing a deterioration in riding comfort, the occurrence of electromagnetic noise, and the like, which are ascribable to degradation of speed control of the motor 4 resulting from a shortage of the output voltage of the inverter 9.

Embodiment 6

Next, Embodiment 6 of the present invention will be described. In Embodiment 6 of the present invention, a load on at least one of the components of the drive means 16 is indirectly monitored from a difference between a current command value and a current measurement value.

Figure 12:
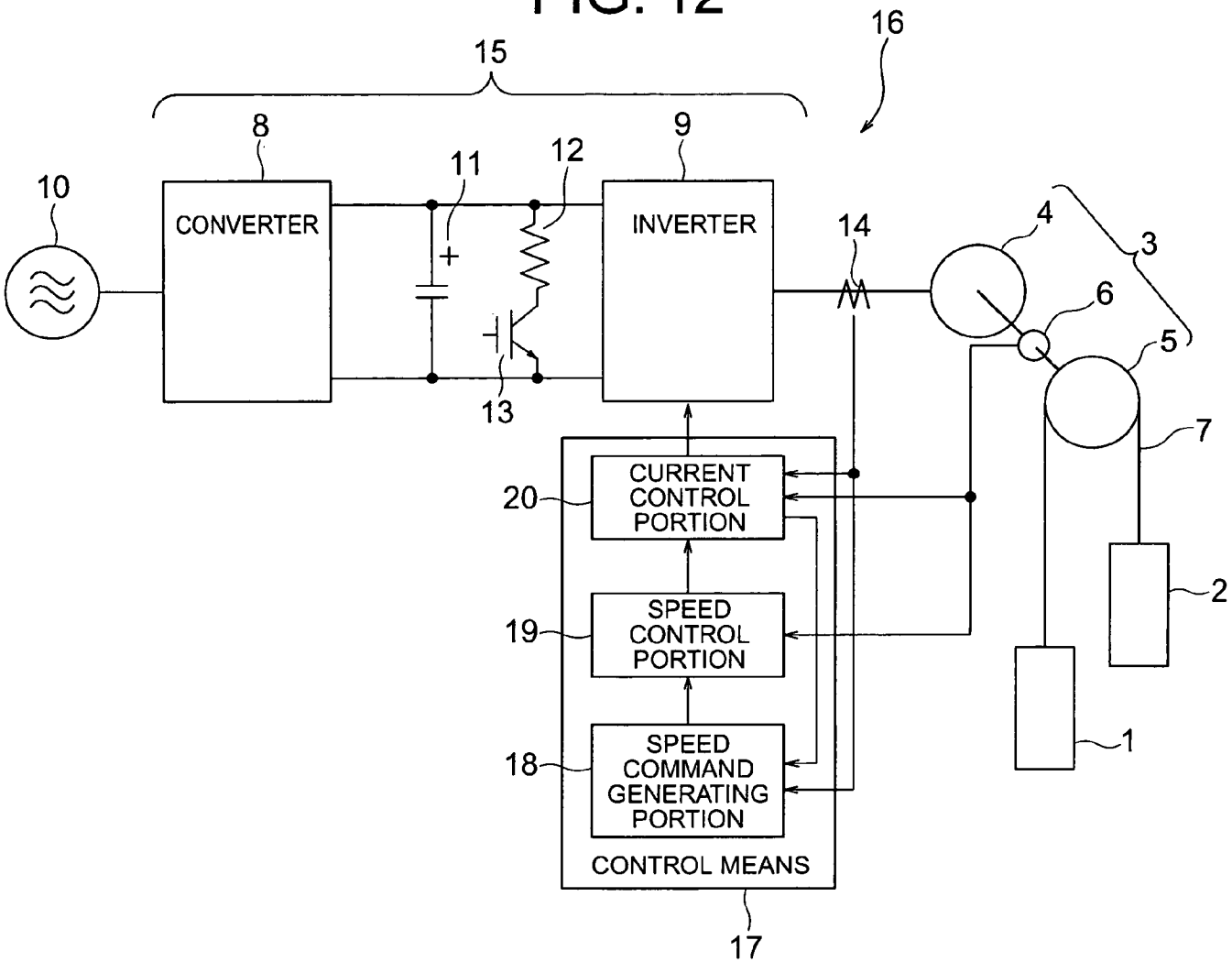
FIG. 12 is a schematic diagram showing an elevator device according to Embodiment 6 of the present invention.

FIG. 12 is a schematic diagram showing an elevator device according to Embodiment 6 of the present invention. Referring to FIG. 12, the speed command generating portion 18 compares a current command value generated by the current control portion 20 with a current measurement value measured based on a signal from the current detector 14 to estimate a load on at least one of the drive components. More specifically, the speed command generating portion 18 monitors at least one of a difference between the current command value and the current measurement value and a derivative value of the difference between the current command value and the current measurement value, and imposes a speed limit when the monitored value reaches a threshold. Embodiment 6 of the present invention is identical to Embodiment 1 or 2 of the present invention in other constructional details and other details about the method of control.

As the current of the motor 4, the voltage of the motor 4, and the power of the motor 4 are saturated due to a power supply capacity or a motor performance, the difference between the current command value and the current measurement value increases. Accordingly, the motor 4 can be prevented from becoming overloaded by monitoring at least one of the difference between the current command value and the current measurement value and the derivative value of the difference between the current command value and the current measurement value. The car 1 can be operated more efficiently by performing the monitoring operation described above, generating a speed command without loss of time, and outputting the speed command to the motor driving portion 15 while the car 1 is running.

Embodiment 7

Next, Embodiment 7 of the present invention will be described. In Embodiment 7 of the present invention, a load on at least one of the components of the drive means 16 is indirectly monitored from a difference between a speed command value and a speed measurement value.

Figure 13:
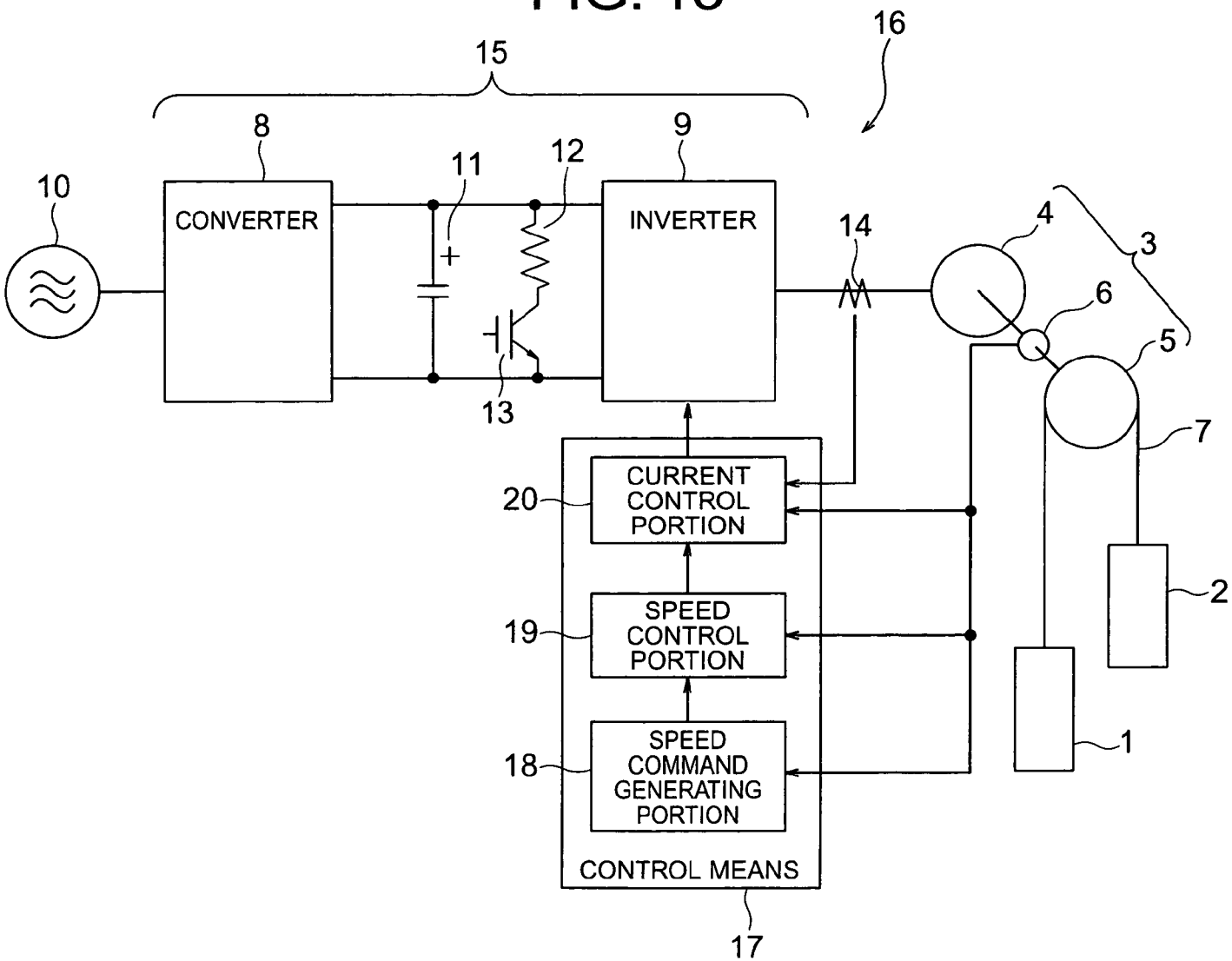
FIG. 13 is a schematic diagram showing an elevator device according to Embodiment 7 of the present invention.

FIG. 13 is a schematic diagram showing an elevator device according to Embodiment 7 of the present invention. Referring to FIG. 13, the speed command generating portion 18 compares a speed command value generated by the speed command generating portion 18 with a speed measurement value measured based on a signal from the speed detector 6 to estimate a load on at least one of the drive components. More specifically, the speed command generating portion 18 monitors at least one of a difference between the speed command value and the speed measurement value and a derivative value of the difference between the speed command value and the speed measurement value, and imposes a speed limit when the monitored value reaches a threshold. Embodiment 7 of the present invention is identical to Embodiment 1 or 2 of the present invention in other constructional details and other details about the method of control.

As the current of the motor 4, the voltage of the motor 4, and the power of the motor 4 are saturated due to a power supply capacity or a motor performance, the difference between the speed command value and the speed measurement value increases. Accordingly, the motor 4 can be prevented from becoming overloaded by monitoring at least one of the difference between the speed command value and the speed measurement value and the derivative value of the difference between the speed command value and the speed measurement value. The car 1 can be operated more efficiently by performing the monitoring operation described above, generating a speed command without loss of time, and outputting the speed command to the motor driving portion 15 while the car 1 is running.

Embodiment 8

Next, Embodiment 8 of the present invention will be described. In Embodiment 8 of the present invention, a regenerative power of the regenerative resistor 12 is monitored as a load on at least one of the components of the drive means 16.

Figure 14:
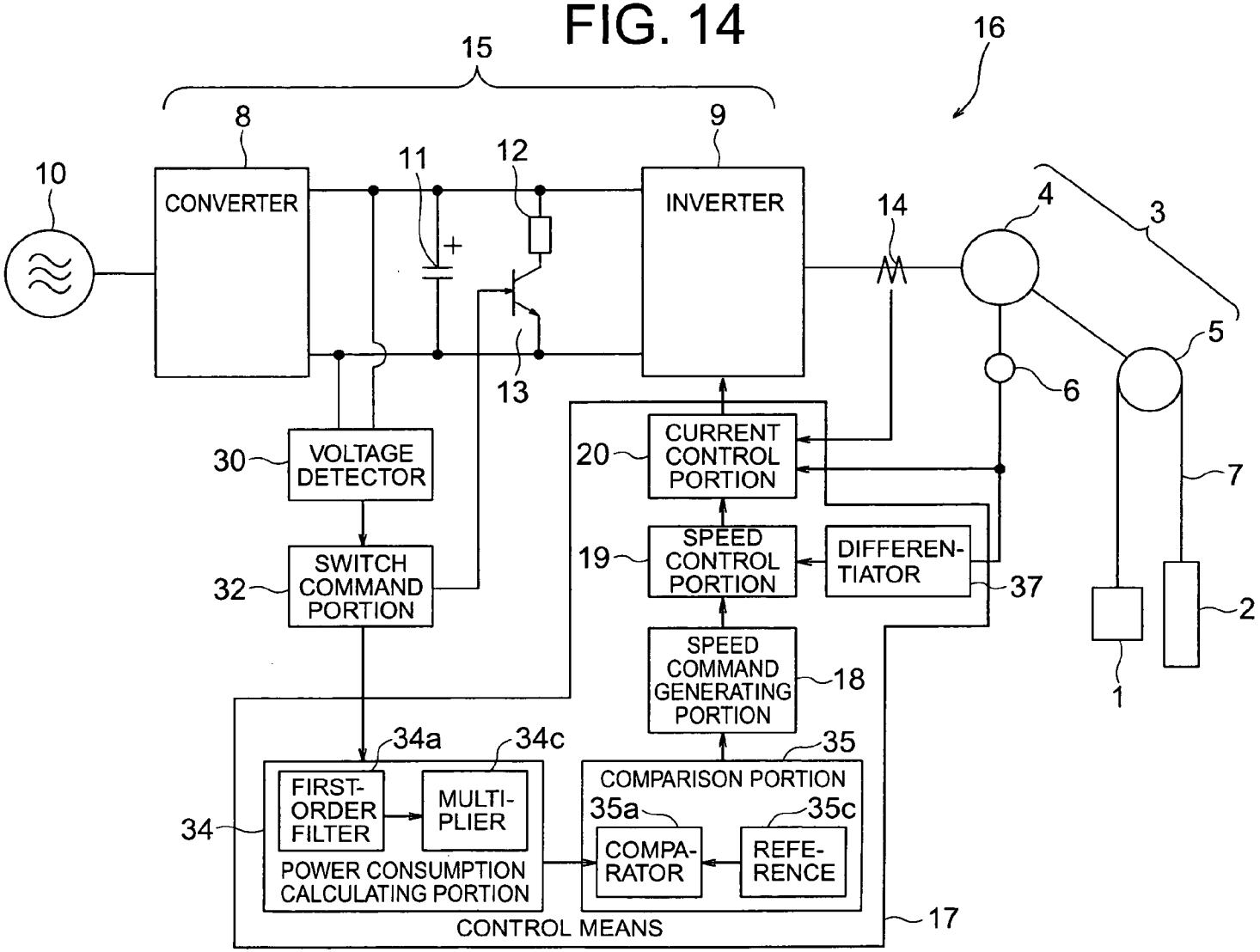
FIG. 14 is a schematic diagram showing an elevator device according to Embodiment 8 of the present invention.
Figure 15A:
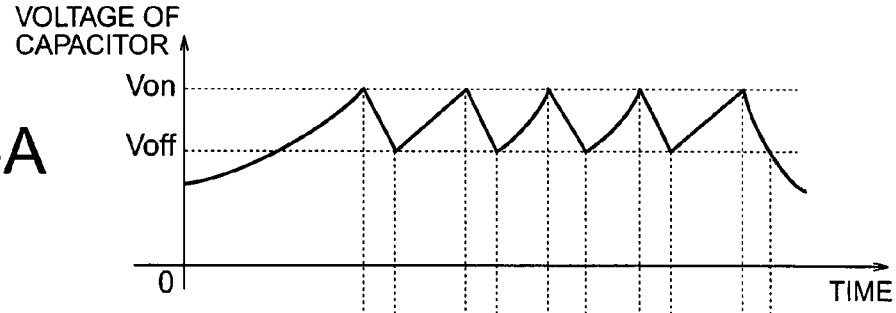
FIG. 15 is composed of graphs showing changes with time in the voltage of a smoothing capacitor of FIG. 14, the ON/OFF state of a regenerative switch of FIG. 14, and the ON ratio of the regenerative switch, respectively.
Figure 15B:
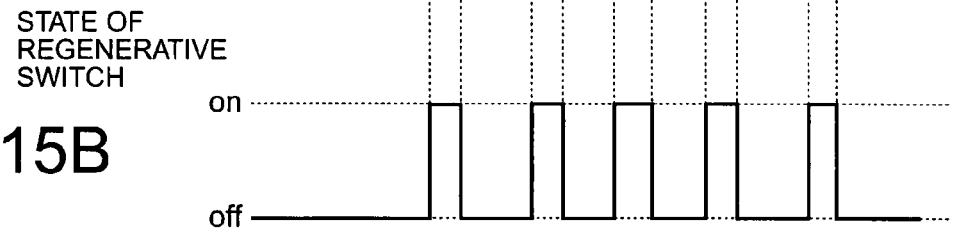
Figure 15C:
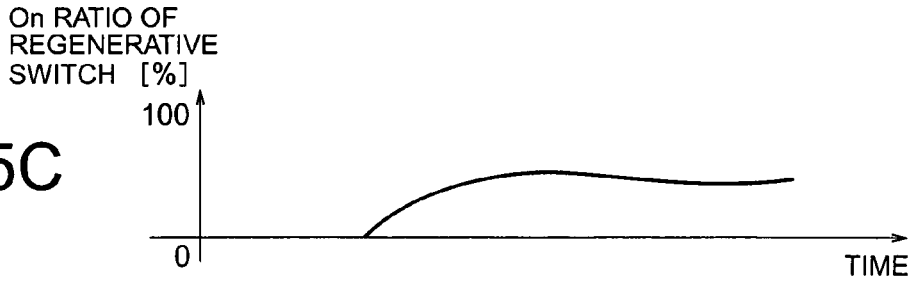
Figure 16A:
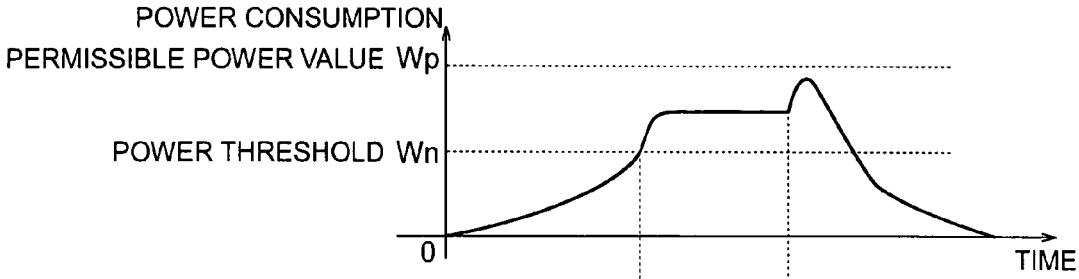
FIG. 16 is composed of graphs showing changes with time in the power consumption of a regenerative resistor of FIG. 14 and the speed of a car of FIG. 14, respectively.
Figure 16B:
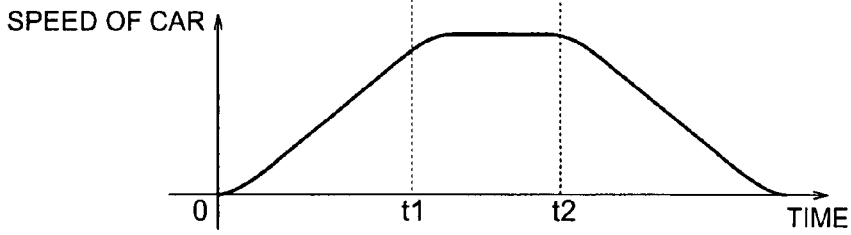

FIG. 14 is a schematic diagram showing an elevator device according to Embodiment 8 of the present invention. FIG. 15 shows graphs of changes with time in the voltage of the smoothing capacitor 11 of FIG. 14, in the ON/OFF state of the regenerative switch 13 of FIG. 14, and in the ON ratio of the regenerative switch 13, respectively. FIG. 16 shows graphs of changes with time in the power consumption of the regenerative resistor 12 of FIG. 14 and the speed of the car 1, respectively.

Referring to FIGS. 14 to 16, the DC voltage of the smoothing capacitor 11 is detected by a voltage detector 30. The turning ON/OFF of the regenerative switch 13 is controlled by a switch command portion 32. As shown in FIG. 15, the switch command portion 32 generates an ON command signal for turning the regenerative switch 13 ON when the DC voltage detected by the voltage detector 30 becomes higher than a preset voltage threshold Von, and generates an OFF command signal for turning the regenerative switch 13 OFF when the DC voltage detected by the voltage detector 30 becomes lower than a voltage threshold Voff.

A power consumption calculating portion 34 calculates a power consumption of the regenerative resistor 12 based on the ON command signal and the OFF command signal from the switch command portion 32. On the assumption that the ON command signal and the OFF command signal from the switch command portion 32 represent an ON state corresponding to 100% and an OFF state corresponding to 0%, respectively, the power consumption calculating portion 34 obtains an output signal indicating the ratio of the ON state of the regenerative switch 13, which has been smoothed as shown in FIG. 15(*c*).

In addition, the power consumption calculating portion 34 has a first-order filter (filter means) 34*a* for a first-order delay having a suitable cutoff frequency, and a multiplier 34*c*. In the multiplier 34*c*, an output signal from the first-order filter 34*c* is multiplied by a coefficient $Von^2/R$ to calculate a power consumption (power consumption-related value), namely, a power consumed by the regenerative resistor 12. It should be noted that $Von^2/R$ denotes an instantaneous power consumption as a power consumed by the regenerative resistor 12, and that R denotes an electric resistance value of the regenerative resistor 12.

A comparison portion 35 has a comparator 35*a* and a reference 35*c*. A power threshold Wn can be set in the reference 35*c*. The comparator 35*a* compares the power consumption calculated by the multiplier 34*c* with the power threshold Wn preset in the reference 35*c*, and inputs a command change signal to the speed command generating portion 18 when the power consumption reaches the power threshold Wn.

The power threshold Wn is set based on a permissible power value Wp for preventing the regenerative resistor 12 from becoming overloaded. More specifically, as shown in FIG. 16, the power threshold Wn is set in consideration of a regenerative power consumption increasing between the time point t1 corresponding to the start of acceleration transition and a time point corresponding to the start of constant-speed running and a regenerative power consumption increasing temporarily from the time point t2 corresponding to the start of deceleration such that the regenerative power consumption does not exceed the permissible power value Wp.

A resistor having a capacity permitting instantaneous consumption of a power corresponding to up to 100% of the ON ratio of the regenerative switch 13 is selected as the regenerative resistor 12. However, in order to suppress the release of heat from the regenerative resistor 12 or the like, the regenerative power consumption is set equal to or lower than a rated power during continuous use of the regenerative resistor 12.

The speed command generating portion 18 continues to generate a speed command value for continuing predetermined acceleration until a command change signal is input thereto. After the command change signal has been input to the speed command generating portion 18, the speed command generating portion 18 generates a speed command signal for causing the car 1 to start running at a constant speed when the car 1 is being accelerated, and generates a speed command signal for decelerating and stopping the car 1 when the car 1 is running at the constant speed to approach a stop position.

Although not described in the foregoing embodiments of the present invention, the rotational speed of the motor 4 is calculated by differentiating a signal from the speed detector (rotational position detector) 6 using a differentiator 37 or the like.

The control means 17 in Embodiment 8 of the present invention has the speed command generating portion 18, the speed control portion 19, the current control portion 20, the power consumption calculating portion 34, the comparison portion 35, and the differentiator 37.

When the car 1 is being lowered with the load of the car 1 larger than the load of the counterweight 2, the motor 4 is in a regenerative state. In the regenerative state, a current flows from the motor 4 toward the inverter 9, so the smoothing capacitor 11 is charged. When the voltage of the smoothing capacitor 11 reaches the voltage threshold Von as a result of the charging thereof, an ON command signal is input from the switch command portion 32 to the regenerative switch 13.

When the regenerative switch 13 is turned ON, a current flows through the regenerative resistor 12 and heat is released from the regenerative resistor 12, so the voltage of the smoothing capacitor 11 drops to Voff. A relationship between current and voltage during this voltage drop is established such that changes in voltage follow the waveform of a first-order delay system, because the regenerative resistor 12 and the smoothing capacitor 11 constitute a closed circuit.

When the voltage of the smoothing capacitor 11 drops to Voff, an OFF command signal is input from the switch command portion 32 to the regenerative switch 13. The regenerative power of the motor 4 is consumed by the regenerative resistor 12 through repetition of the operation described above. The DC voltage input to the inverter 9 is controlled within a prescribed range by turning the regenerative switch 13 ON and OFF in accordance with the voltage of the smoothing capacitor 11.

The first-order filter 34*a* of the power consumption calculating portion 34 smoothes a pulse-shaped ON/OFF command signal from the switch command portion 32 as shown in FIG. 15(*c*) and outputs the ON/OFF command signal as a smoothed signal. The smoothed signal indicates the ratio of an ON time period, namely, a time period in which the ON command signal constituting the ON/OFF command signal for the regenerative switch 13 is generated. An average power consumption of the regenerative resistor 12 can thereby be estimated. Accordingly, an average power consumption value can be calculated by multiplying the smoothed signal by the coefficient $Von^2/R$ in the multiplier 34*c*.

The comparator 35*a* compares the power consumption with the power threshold Wn, and inputs a command change signal to the speed command generating portion 18 when the power consumption exceeds the power threshold Wn. As shown in FIG. 16(*a*), the power consumption gradually increases as the car 1 increases in speed after having started running. Then, the power consumption reaches the power threshold Wn at the time point t1 when the car 1 is running with accelerating speed.

When the power consumption exceeds the power threshold Wn, the comparator 35*a* outputs a command change signal to the speed command generating portion 18. When the command change signal is input to the speed command generating portion 18, the speed command generating portion 18 generates a speed command to stop the car 1 from being accelerated if the car 1 is being accelerated, and to make a shift to constant-speed running, and outputs the speed command to the speed control portion 19. In this case, it is preferable to make a shift from the state of acceleration to the state of constant speed along a smooth curve in consideration of riding comfort of passengers.

When the car 1 reaches a deceleration start position at the time point t2 while running at a constant speed, the speed command generating portion 18 generates a speed command to decelerate and stop the car 1. The car 1 is thereby decelerated and stopped. Embodiment 8 of the present invention is identical to Embodiment 1 or 2 of the present invention in other constructional details and other details about the method of control.

In the elevator device structured as described above, the power consumption of the regenerative resistor 12 is monitored while the car 1 is running, and the control command regarding the running speed of the car 1 is generated in accordance with the state of the power consumption and then output to the motor driving portion 15. It is therefore possible to operate the car 1 more efficiently while preventing at least one of the drive components from becoming overloaded.

Although the first-order filter 34*a* is employed to calculate the ratio of the ON time period of the regenerative switch 13 in Embodiment 8 of the present invention, a high-order filter may be employed to perform the calculation. It is also appropriate to detect an ON time period and an OFF time period of the regenerative switch 13 within a preset time period to calculate the ratio of the ON time period.

It is also appropriate to omit the multiplier 34*c* and input an output from the first-order filter 34*a* directly to the comparison portion 35.

Further, the current flowing when the regenerative switch 13 is turned ON is approximated as Von/R in Embodiment 8 of the present invention. On the other hand, it is also appropriate to approximate the current as, for example, Voff/R or (Von+Voff)/R/2 on the assumption that a predetermined voltage between an ON start voltage Von and an OFF start voltage Voff is applied to the regenerative resistor 12.

Still further, the amount of the increase in regenerative power increases notably when the car 1 makes a shift from accelerated running to constant-speed running and when the car 1 makes a shift from constant-speed running to decelerated running. It is therefore appropriate to set the power threshold Wn in consideration of the amount of the increase in regenerative power. That is, it is appropriate to obtain the power threshold Wn by subtracting the amount of the increase in regenerative power from a permissible power allowed to be regenerated through the regenerative resistor 12.

The amount of the increase in regenerative power depends on the acceleration/deceleration of the car 1. The acceleration/deceleration of the car 1 depends on the motor torque generated by the motor 4. The motor torque can be calculated through conversion from the current of the motor 4. It is therefore appropriate to calculate the power threshold Wn in accordance with at least one of the acceleration/deceleration, the torque, and the current.

Further, the regenerative power increasing between the time point corresponding to the start of acceleration transition and the time point corresponding to the start of constant-speed running depends also on the acceleration transition pattern in a shift to constant-speed running. That is, the amount of the increase in regenerative power increases as the time period for acceleration transition is lengthened. The regenerative power increasing temporarily at the time point corresponding to the start of deceleration depends on the deceleration transition pattern in a shift to decelerated running. That is, the amount of the increase in regenerative power increases as the time period for deceleration transition is shortened. It is therefore appropriate to set the power threshold Wn in accordance with the acceleration (deceleration) transition pattern such that the regenerative power does not exceed the permissible value Wp. Alternatively, it is also appropriate to set the acceleration (deceleration) transition pattern in accordance with the power threshold Wn such that the regenerative power does not exceed the permissible value Wp. In addition, it is appropriate to reset the power threshold Wn every time the car 1 runs.

Still further, the speed at which the car 1 is operated can be increased as the power threshold Wn is increased. However, as the power threshold Wn is increased, it becomes more difficult to increase the deceleration of the car 1, and the time period for deceleration transition needs to be lengthened. Thus, in respect of a reduction in operating time, there is a relationship of trade-off between the power threshold Wn and the deceleration of the car 1 and between the power threshold Wn and the deceleration transition pattern of the car 1. Accordingly, it is preferable to set the power threshold Wn, the deceleration of the car 1, and the deceleration transition pattern of the car 1 such that the running time of the car 1 is reduced to the shortest possible time.

Embodiment 9

Next, Embodiment 9 of the present invention will be described. In Embodiment 9 of the present invention, a heat release amount or a temperature of the regenerative resistor 12 is monitored as a load on at least one of the components of the drive means 16.

Figure 17:
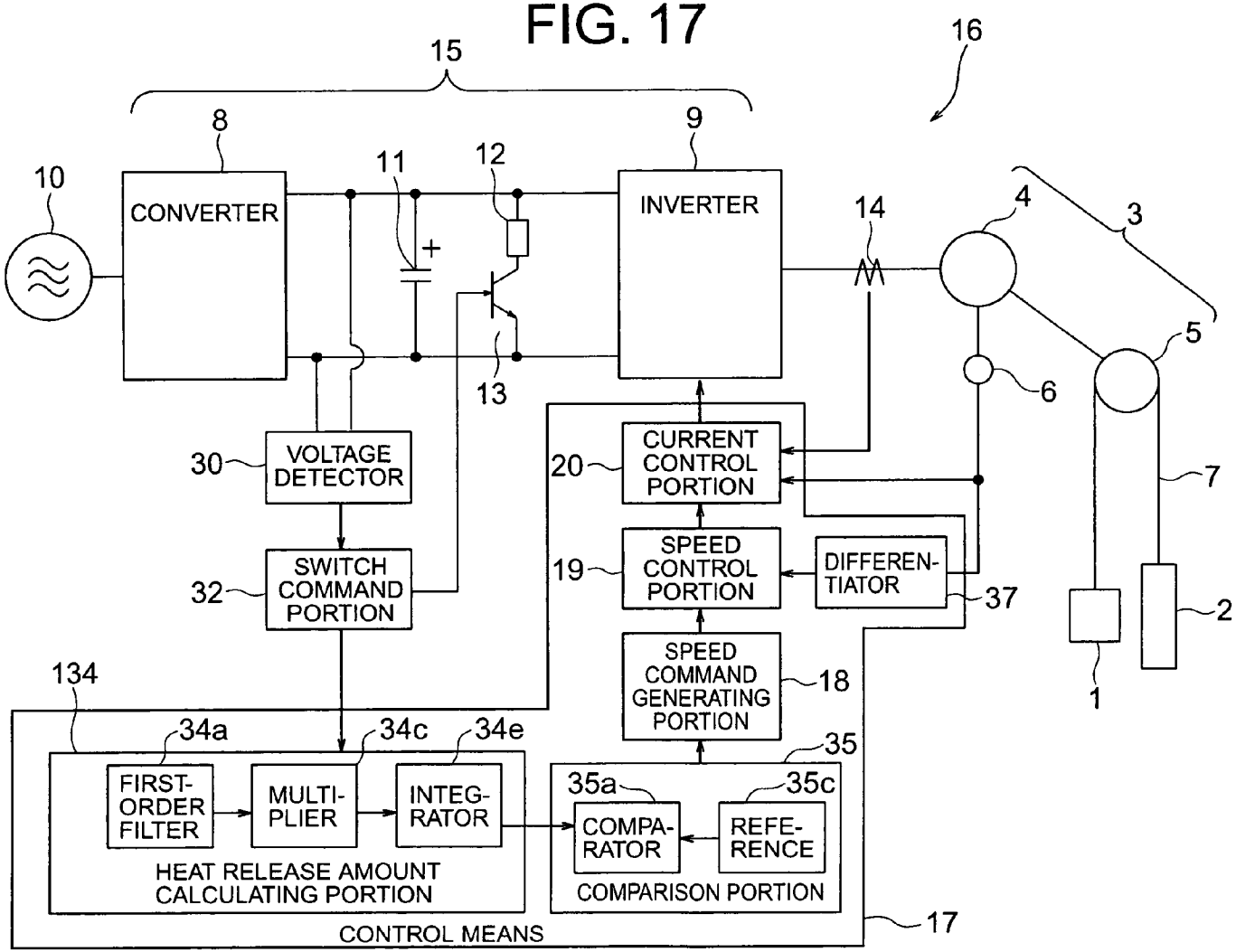
FIG. 17 is a schematic diagram showing an elevator device according to Embodiment 9 of the present invention.

FIG. 17 is a schematic diagram showing an elevator device according to Embodiment 9 of the present invention. Referring to FIG. 17, a heat release amount calculating portion 134 has the first-order filter 34*a*, the multiplier 34*c*, and an integrator 34*e*. The integrator 34*e* calculates an estimated value of the heat release amount of the regenerative resistor 12 from a value obtained by integrating (accumulating) a power consumption obtained from the multiplier 34*c* over time.

A threshold of a heat release amount (temperature threshold) can be set in the reference 35*c*. The comparator 35*a* compares the estimated value of the heat release amount calculated by the integrator 34*e* with the threshold of the heat release amount preset in the reference 35*c*, and inputs a command change signal to the speed command generating portion 18 when the estimated value of the heat release amount reaches the threshold of the heat release amount. The threshold of the heat release amount is set based on a permissible temperature for preventing the regenerative resistor 12 from becoming overloaded. Embodiment 9 of the present invention is identical to Embodiment 8 of the present invention in other constructional details.

In the elevator device structured as described above, the heat release amount of the regenerative resistor 12 is monitored while the car 1 is running, and the control command regarding the running speed of the car 1 is generated in accordance with the heat release amount and then output to the motor driving portion 15. It is therefore possible to operate the car 1 more efficiently while preventing at least one of the drive components from becoming overloaded.

Embodiment 10

Next, Embodiment 10 of the present invention will be described. In Embodiment 10 of the present invention as well as Embodiment 9 of the present invention, the heat release amount of the regenerative resistor 12 is monitored as a load on at least one of the components of the drive means 16. Note that, in Embodiment 10 of the present invention, the threshold of the heat release amount is varied in accordance with the power consumption of the regenerative resistor 12.

Figure 18:
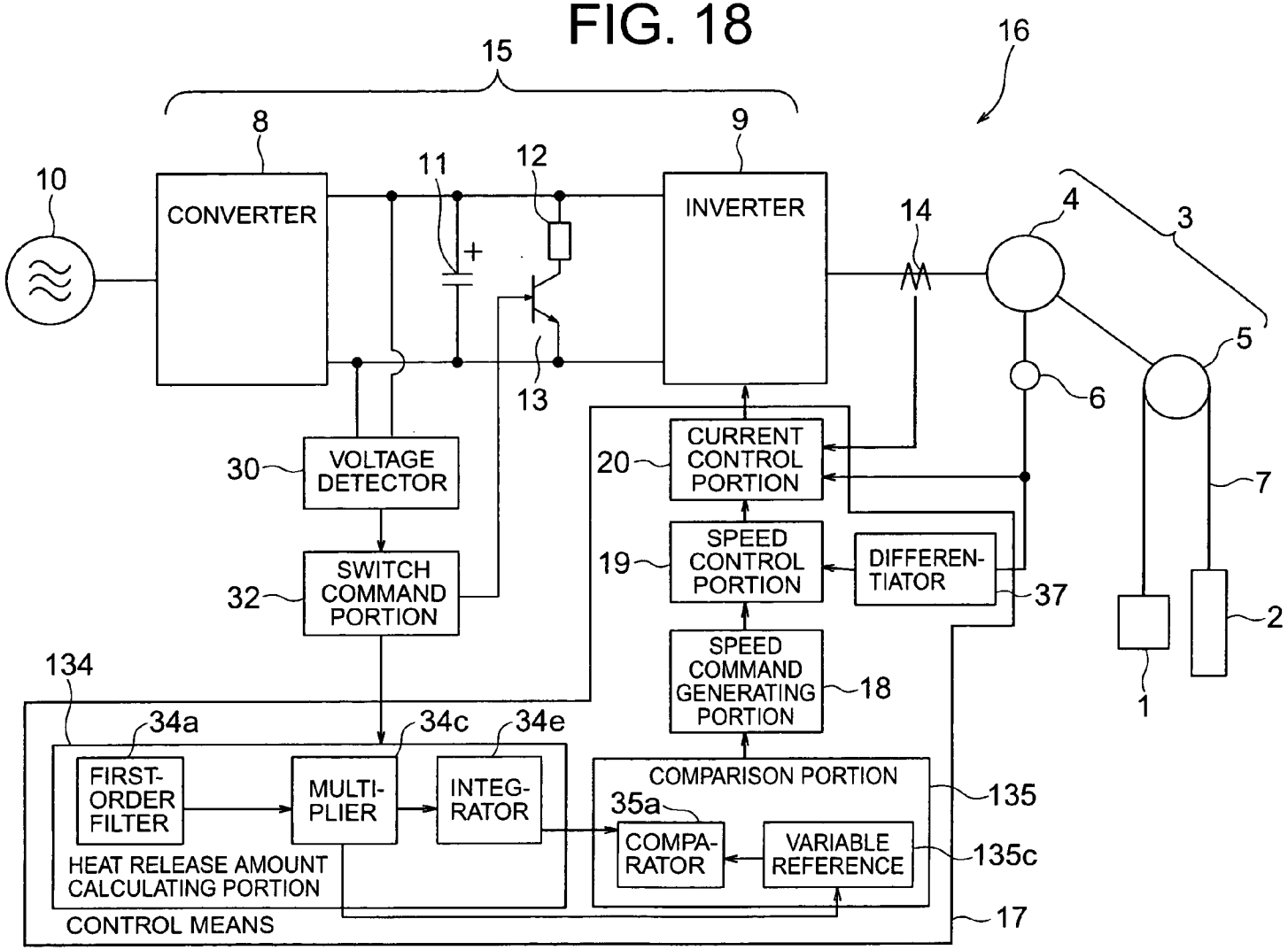
FIG. 18 is a schematic diagram showing an elevator device according to Embodiment 10 of the present invention.

FIG. 18 is a schematic diagram showing an elevator device according to Embodiment 10 of the present invention. Referring to FIG. 18, a comparison portion 135 has the comparator 35*a* and a variable reference 135*c*. The variable reference 135*c* calculates a power consumption of the regenerative resistor 12 per predetermined time based on information from the multiplier 34*c*, and changes the threshold of the heat release amount in accordance with a result of the calculation.

Figure 19:
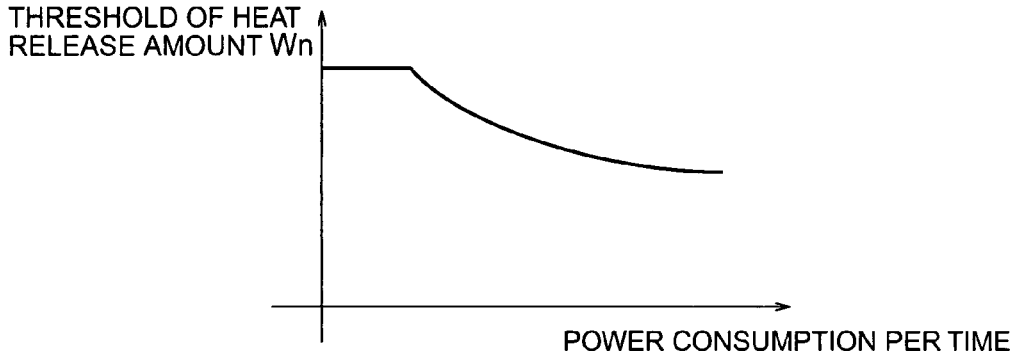
FIG. 19 is a graph showing an example of a method of setting a threshold of a heat release amount in a variable reference of FIG. 18.

FIG. 19 is a graph showing an example of a method of setting a threshold of a heat release amount in the variable reference 135*c* of FIG. 18. As shown in FIG. 19, the threshold of the heat release amount is reduced as the power consumption of the regenerative resistor 12 per predetermined time increases. Embodiment 10 of the present invention is identical to Embodiment 9 of the present invention in other constructional details and other details about the method of control.

In the elevator device structured as described above, the threshold of the heat release amount is shifted in accordance with the power consumption of the regenerative resistor 12 per predetermined time. It is therefore possible to more reliably prevent the regenerative resistor 12 from becoming overloaded by suitably changing the threshold of the heat release amount in accordance with the operating frequency of the car 1. For example, when the operating frequency of the car 1 becomes high, the power consumption of the regenerative resistor 12 per predetermined time increases, so the heat release amount rises abruptly. As a measure against this phenomenon, the threshold of the heat release amount is reduced to some extent. It is therefore possible to prevent the regenerative resistor 12 from becoming overloaded due to a control delay.

It is also appropriate to estimate the heat release amount of the regenerative resistor 12 based on an average power consumption. By selecting the time constant of the first-order filter 34*a* as a value approximately equal to the thermal time constant of the regenerative resistor 12, the average power consumption can be calculated as a value obtained by multiplying an output from the first-order filter 34*a* by $Von^2/R$.

Embodiment 11

Next, Embodiment 11 of the present invention will be described. In Embodiment 11 of the present invention, a motor voltage and a motor current are monitored as loads on at least one of the components of the drive means 16.

Figure 20:
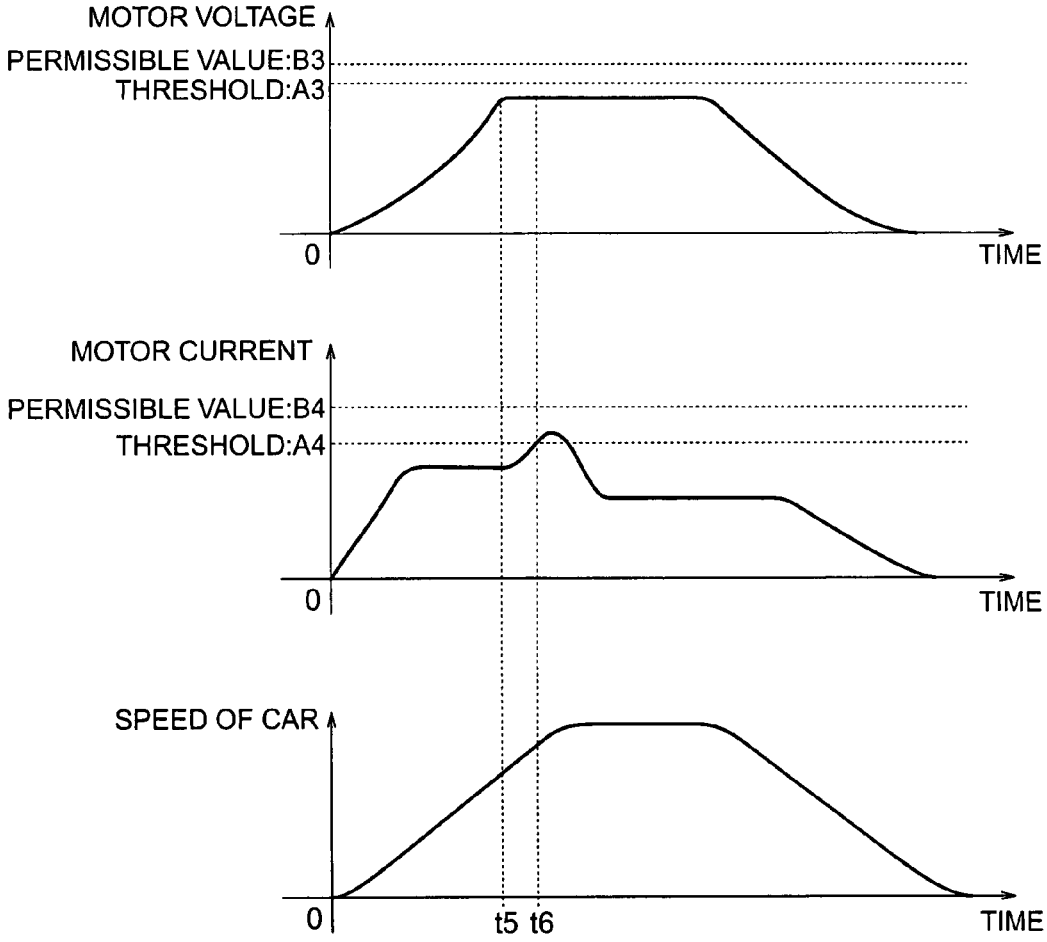
FIG. 20 is composed of graphs showing a method of controlling the speed of a car in an elevator device according to Embodiment 11 of the present invention.

FIG. 20 is composed of graphs showing a method of controlling the speed of the car 1 in an elevator device according to Embodiment 11 of the present invention. These graphs illustrate an example in which flux weakening control of the motor 4 is performed. The overall construction of the device is identical to that of Embodiment of the present invention (FIG. 11).

Flux weakening control is a method of controlling the motor 4 such that a negative d-axis current is caused to flow through the motor 4 to suppress a rise in the voltage thereof and hence allow the motor 4 to rotate at high-speed. In the case of flux weakening control, when the voltage of the motor 4 rises due to acceleration of the car 1 after the car 1 has started running, flux weakening control is performed to cause the d-axis current to start flowing such that the voltage of the motor 4 does not exceed a threshold A3. In this example, the motor voltage is fixed to the threshold A3 at a time point t5. That is, flux weakening control is started at the time point t5 such that no more than a required amount of the d-axis current is caused to flow.

The value of the motor voltage is held equal to or lower than the threshold A3 through flux weakening control. However, as the speed of the car 1 increases, the d-axis current for suppressing an increase in the voltage of the motor 4 increases as well, so the motor current increases. At this moment, the motor current is also monitored in Embodiment 11 of the present invention. When the value of the motor current exceeds a threshold A4, it is determined that the car 1 is running at a critical speed permitting flux weakening control. Thus, a speed command is shifted to a speed command value for constant-speed running.

The threshold A4 is set based on a permissible current B4 of the motor 4 or the inverter 9. The motor current increases temporarily between a time point t6 corresponding to the start of acceleration transition and a time point corresponding to the start of constant-speed running. In this case as well, however, the threshold A4 is set such that the motor current does not exceed the permissible value B4.

Owing to the foregoing measure, it is possible to prevent a deterioration in riding comfort, which is ascribable to degradation of speed control of the motor 4 resulting from a shortage of the output voltage of the inverter 9, the occurrence of electromagnetic noise, and the like. It is also possible to prevent the motor 4 or the inverter 9 from becoming overloaded due to an overcurrent.

The speed of the car 1 can be increased insofar as the drive component is not overloaded. As a result, traveling efficiency is improved.

In the case illustrated in Embodiment 11 of the present invention, the value of the motor current exceeds the threshold A4 after the value of the motor voltage has become constant through flux weakening control. However, when the value of the motor voltage exceeds the threshold A3 before the value of the motor current exceeds the threshold A4 in the case where, for example, flux weakening control is not performed, a shift to constant-speed running is made immediately.

In Embodiment 11 of the present invention, even when the voltage allowed to be output from the inverter 9 fluctuates, for example, when the voltage of the power supply 10 drops, in accordance with the fluctuation in the voltage of the power supply 10, a speed command value can be increased suitably within a range allowing the inverter 9 to output the voltage.

The invention claimed is:

1. An elevator device, comprising:

drive means including a drive sheave, a motor for rotating the drive sheave, and a motor driving portion for driving the motor;

suspension means looped around the drive sheave;

a car and a counterweight that are suspended by the suspension means to be raised/lowered by the drive means; and control means for controlling the motor driving portion, wherein the control means monitors a load on at least one component of the drive sheave, the motor for rotating the drive sheave, and the motor driving portion for driving the motor within the drive means, by monitoring at least one of a current, a temperature, a power, a switching duty, or a motor voltage of the at least one component while that at least one component is operating and while the car is running, generates a control command regarding a running speed of the car on a real-time basis in accordance with a state of the load, and outputs the control command to the motor driving portion, wherein (i) the control means continuously raises the running speed of the car after the car has started running, until the running speed of the car reaches an upper limit that is prescribed when the car starts running, and holds the running speed of the car at the upper limit to make a shift to constant-speed running unless the load monitored while the at least one component is operating and while the car is running reaches a preset threshold, and (ii) when the load monitored while the at least one component is operating and while the car is running reaches the preset threshold before the running speed of the car reaches the upper limit, the control means shifts to a constant-speed running at a speed lower than the upper limit.

2. The elevator device according to claim 1, wherein the control means continuously raises the running speed of the car after the car has started running, and reduces an acceleration of the car when the load reaches the threshold.

3. The elevator device according to claim 2, wherein the control means raises the acceleration of the car until the acceleration of the car reaches a predetermined acceleration after the car has started running.

4. The elevator device according to claim 1, wherein, when the load reaches the threshold during accelerated running of the car, the control means generates the control command such that the car is allowed to run at a constant speed.

5. The elevator device according to claim 1, wherein, when the load reaches the threshold during accelerated running of the car, the control means generates the control command such that the load is held at the preset threshold.

6. The elevator device according to claim 1, wherein the control means monitors at least one of a current, a voltage, and a temperature of the motor as the load.

7. The elevator device according to claim 1, wherein;

the motor driving portion comprises an inverter; and the control means monitors at least one of a current, a temperature, a switching duty, and a voltage of the inverter as the load.

8. The elevator device according to claim 1, wherein the control means converts a current supplied to the motor into a d-axis current and a q-axis current in a Cartesian coordinate system, and monitors at least one of the d-axis current and the q-axis current as the load.

9. The elevator device according to claim 1, wherein:

the motor driving portion comprises an inverter; and the control means generates a d-axis current command and a q-axis current command in a Cartesian coordinate system to control the inverter, and monitors at least one of the d-axis current command and the q-axis current command as the load.

10. The elevator device according to claim 1, wherein:

the motor driving portion comprises an inverter; and the control means monitors a power supplied from the inverter to the motor as the load.

11. The elevator device according to claim 1, wherein:

the motor driving portion comprises a regenerative resistor; and the control means monitors a temperature of the regenerative resistor as the load.

12. The elevator device according to claim 1, wherein:

the motor driving portion comprises a regenerative resistor, and the control means monitors a regenerative power obtained through the regenerative resistor as the load.

13. The elevator device according to claim 1, wherein:

the motor driving portion comprises an inverter, and a breaker connected between the inverter and a power supply; and the control means monitors a current flowing through the breaker as the load.

14. The elevator device according to claim 1, wherein:

the motor driving portion comprises an inverter, and a converter connected between the inverter and a power supply; and the control means monitors a DC voltage input from the converter to the inverter.

15. The elevator device according to claim 1, wherein:

the motor driving portion comprises an inverter; and the control means comprising a current control portion for generating a current command to control the inverter, compares a current supplied from the inverter to the motor with the current command to indirectly monitor the load.

16. The elevator device according to claim 1, wherein:

the drive means is provided with a speed detector for detecting a rotational speed of the motor; and the control means comprising a speed command generating portion for generating a speed command as the control command regarding the rotational speed of the motor, compares the speed detected by the speed detector with the speed command to indirectlyonitor the load.

* * * * *